US011678737B2

(12) United States Patent
Pringle-Iv et al.

(10) Patent No.: US 11,678,737 B2
(45) Date of Patent: Jun. 20, 2023

(54) METHODS FOR CLEANING A SURFACE

(71) Applicant: The Boeing Company, Chicago, IL (US)

(72) Inventors: John W. Pringle-Iv, Gardena, CA (US); Raul Tomuta, Stanton, CA (US); Chris J. Erickson, Garden Grove, CA (US)

(73) Assignee: The Boeing Company, Arlington, VA (US)

( * ) Notice: Subject to any disclaimer, the term of this patent is extended or adjusted under 35 U.S.C. 154(b) by 236 days.

(21) Appl. No.: 16/739,412

(22) Filed: Jan. 10, 2020

(65) Prior Publication Data

US 2020/0146434 A1 May 14, 2020

Related U.S. Application Data

(62) Division of application No. 15/890,923, filed on Feb. 7, 2018, now Pat. No. 10,575,628.

(51) Int. Cl.

| | |
|---|---|
| ***A46B 13/02*** | (2006.01) |
| ***A47L 7/02*** | (2006.01) |
| ***A47L 7/00*** | (2006.01) |
| ***B08B 1/00*** | (2006.01) |
| ***B08B 5/04*** | (2006.01) |
| ***B08B 1/04*** | (2006.01) |

(52) U.S. Cl.

CPC ..... *A46B 13/02* (2013.01); *A47L 7/0076* (2013.01); *A47L 7/02* (2013.01); *B08B 1/002* (2013.01); *B08B 1/04* (2013.01); *B08B 5/04* (2013.01)

(58) Field of Classification Search

CPC ..... A46B 13/02; A47L 7/0076; A47L 7/02; B08B 1/002; B08B 1/04; B08B 5/04

See application file for complete search history.

(56) References Cited

U.S. PATENT DOCUMENTS

| | | | |
|---|---|---|---|
| 7,377,838 | B1 | 5/2008 | Van Vliet |
| 2007/0226926 | A1 | 10/2007 | Hiraoka |
| 2011/0289717 | A1 | 12/2011 | Dhanvanthari |
| 2015/0158601 | A1 | 6/2015 | Topf et al. |
| 2016/0052026 | A1 | 2/2016 | Chin et al. |
| 2016/0361734 | A1 | 12/2016 | Routen et al. |
| 2017/0105516 | A1 | 4/2017 | Pringle-Iv et al. |

(Continued)

FOREIGN PATENT DOCUMENTS

| | | |
|---|---|---|
| CN | 201127394 | 10/2008 |
| CN | 201720766 | 1/2011 |

(Continued)

OTHER PUBLICATIONS

China National Intellectual Property Administration, Office Action, with English translation, App. No. 201910104657.5 (dated Feb. 18, 2022).

(Continued)

*Primary Examiner* — David Redding

(74) *Attorney, Agent, or Firm* — Walters & Wasylyna LLC

(57) ABSTRACT

A method of cleaning a surface includes positioning a brush in contact with the surface. The method further includes rotating the brush about a second axis relative to a drum. The method also includes rotating the drum about a first axis relative to a bracket, connected to a handle and rotatably supporting the drum, such that the brush orbitally revolves about the first axis. The first axis is parallel to the second axis.

20 Claims, 24 Drawing Sheets

(56) References Cited

U.S. PATENT DOCUMENTS

| | | | |
|---|---|---|---|
| 2017/0106401 | A1 | 4/2017 | Pringle-Iv et al. |
| 2017/0106402 | A1 | 4/2017 | Pringle-Iv et al. |
| 2018/0271484 | A1 | 9/2018 | Whisler |
| 2018/0272372 | A1 | 9/2018 | Pringle-Iv et al. |
| 2018/0272373 | A1 | 9/2018 | Pringle-Iv et al. |

FOREIGN PATENT DOCUMENTS

| | | |
|---|---|---|
| CN | 104084651 | 10/2014 |
| CN | 104918529 | 9/2015 |
| CN | 104968471 | 10/2015 |
| CN | 106000947 | 10/2016 |
| CN | 106335118 | 1/2017 |
| CN | 106377056 | 2/2017 |
| DE | 298 12 213 | 10/1998 |
| DE | 20 2013005169 | 10/2013 |
| EP | 1 941 823 | 7/2008 |
| EP | 3 257 419 | 12/2017 |
| JP | 2015-009446 | 12/2022 |
| WO | WO 2017/106900 | 6/2017 |

OTHER PUBLICATIONS

China National Intellectual Property Administration, Office Action, with English translation, App. No. 201910104657.5 (dated Jul. 1, 2022).

Japan Patent Office, Office Action, with English translation, App. No. 2019-009446 (dated Dec. 6, 2022).

continued to FIG. 1B

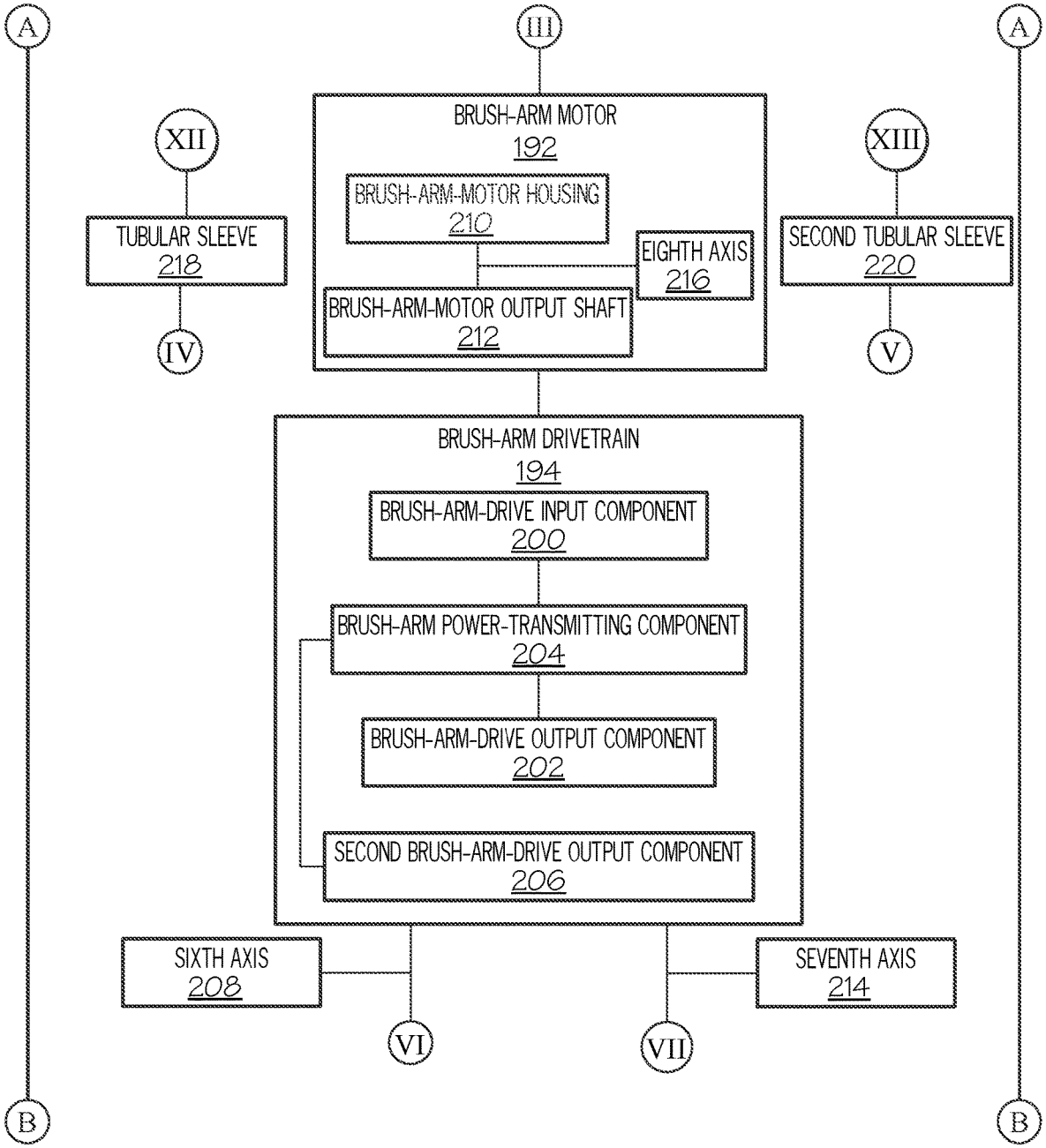
FIG. 1B
continued from FIG. 1A
continued to FIG. 1C

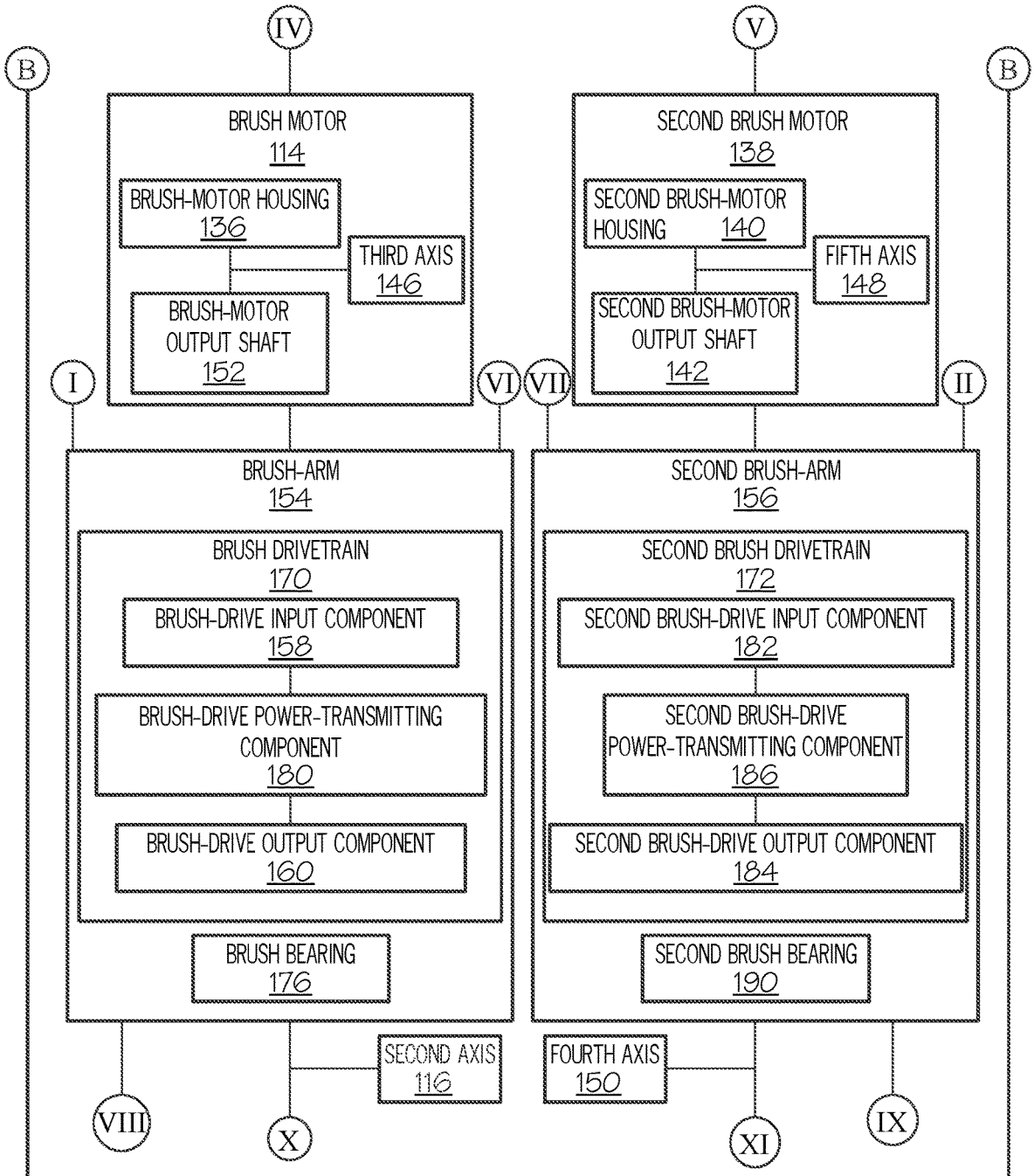
FIG. 1C
continued from FIG. 1B
continued to FIG. 1D

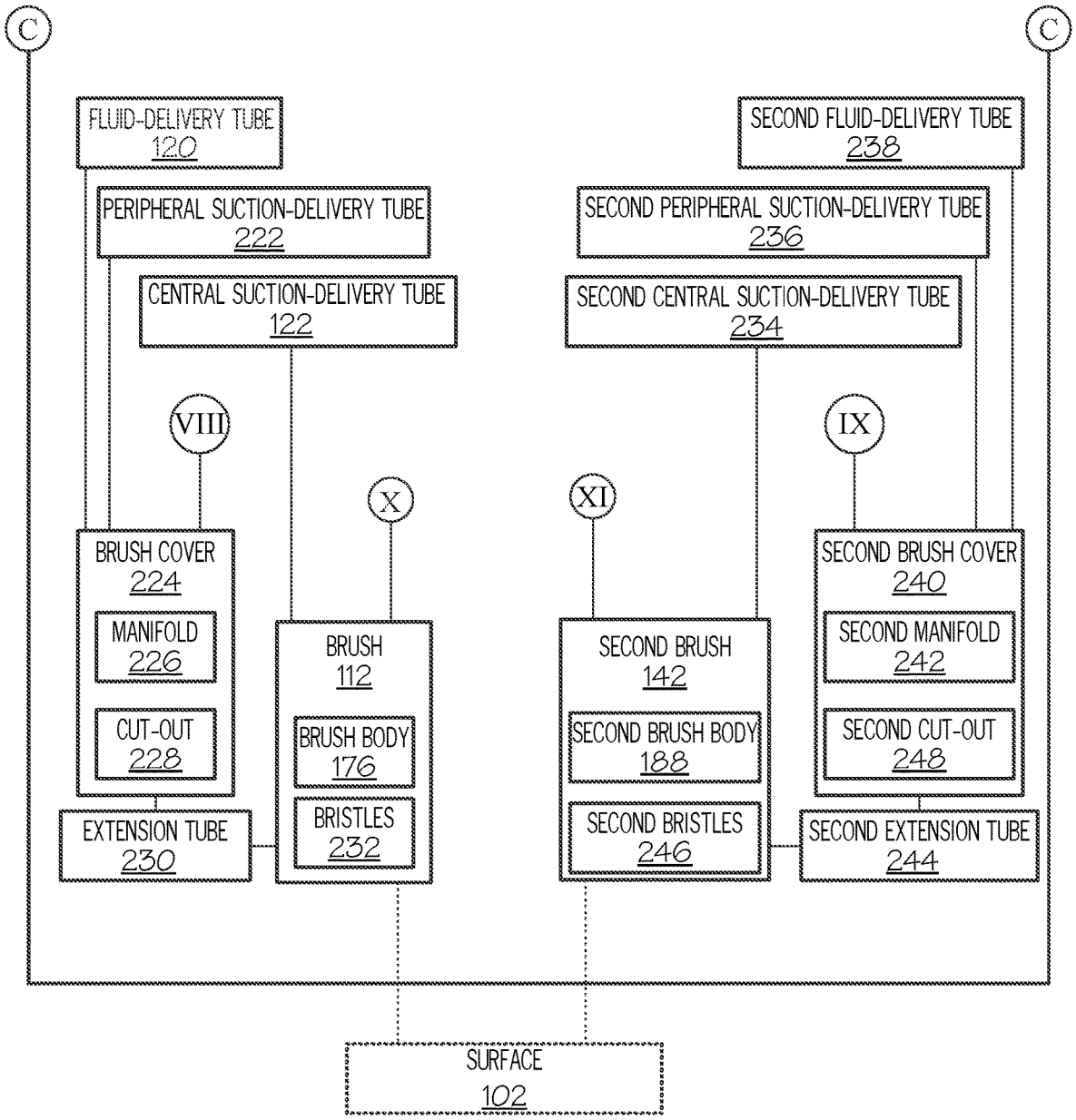
FIG. 1D
continued from FIG. 1C

METHODS FOR CLEANING A SURFACE

PRIORITY

This application is a divisional of U.S. Ser. No. 15/890,923 filed on Feb. 7, 2018.

TECHNICAL FIELD

The present disclosure relates to apparatuses and methods for cleaning a surface.

BACKGROUND

During manufacture of a structure, such as an aircraft or a component thereof, various contaminants must often be removed from a surface of the structure. It is desirable to partially automate such cleaning to reduce cost and manufacturing lead-time. However, space constraints, in many instances imposed by the geometry of the structure or the surface, make partially automating the cleaning process difficult. For example, a cleaning device may need to clean a surface, located in a confined space within the structure, such as inside an airplane wing box that, at the tip, is only several inches deep. Additionally, when manually cleaning the surface, exposure to fumes, for example, generated by cleaning fluids and/or other chemicals, often requires the use of bulky and expensive safety equipment.

SUMMARY

Accordingly, apparatuses and methods, intended to address at least the above-identified concerns, would find utility.

The following is a non-exhaustive list of examples, which may or may not be claimed, of the subject matter according to the invention.

One example of the subject matter, according to the invention, relates to an apparatus for cleaning a surface. The apparatus comprises a handle and a bracket, connected to the handle. The apparatus further comprises a drum, rotatably coupled to the bracket and rotatable about a first axis relative to the bracket. The apparatus also comprises a drum motor, mounted to the handle, and a drum power-transmitting component, rotationally coupling the drum motor and the drum. The apparatus additionally comprises a brush motor, mounted to the drum, and a brush, rotatable by the brush motor relative to the drum about a second axis, which is parallel to the first axis.

The apparatus enables partially automated, manual cleaning of the surface. The bracket supports the drum and enables the drum to be connected to the handle. The handle enables manual control and adjustment of the apparatus relative to the surface. With the brush positioned in contact with the surface, rotation of the brush relative to the drum about the second axis provides a first cleaning action to the surface (e.g., spinning the brush about the second axis on the surface). With the brush positioned in contact with the surface, rotation of the drum relative to the bracket about the first axis orbitally revolves the brush about the first axis relative to the surface along a cleaning path relative to the surface and provides a second cleaning action to the surface (e.g., orbitally revolving the brush about the first axis on the surface). The configuration of the drum, the brush motor, and the brush beneficially reduces the overall size of the apparatus and enables the apparatus to clean one or more surfaces of a structure or other article, for example, located within a confined space.

Another example of the subject matter, according to the invention, relates to a method of cleaning a surface. The method comprises (1) positioning a brush in contact with the surface, (2) rotating the brush about a second axis relative to a drum, and (3) rotating the drum about a first axis relative to a bracket, connected to a handle and rotatably supporting the drum, such that the brush orbitally revolves about the first axis. The first axis is parallel to the second axis.

The method enables partially automated cleaning of (e.g., removal of contaminates from) the surface. With the brush positioned in contact with the surface, rotation of the brush relative to the drum about the second axis provides the first cleaning action to the surface (e.g., spinning the brush about the second axis on the surface). With the brush positioned in contact with the surface, rotation of the drum relative to the bracket about the first axis orbitally revolves the brush about the first axis relative to the surface along the cleaning path relative to the surface and provides the second cleaning action to the surface (e.g., orbitally revolving the brush about the first axis on the surface). The configuration of the drum, the brush motor, and the brush beneficially reduces the overall size of the apparatus and enables the apparatus to clean one or more surfaces of a structure or other article, for example, located within a confined space.

BRIEF DESCRIPTION OF THE DRAWINGS

Having thus described one or more examples of the invention in general terms, reference will now be made to the accompanying drawings, which are not necessarily drawn to scale, and wherein like reference characters designate the same or similar parts throughout the several views, and wherein:

Figure 1A:
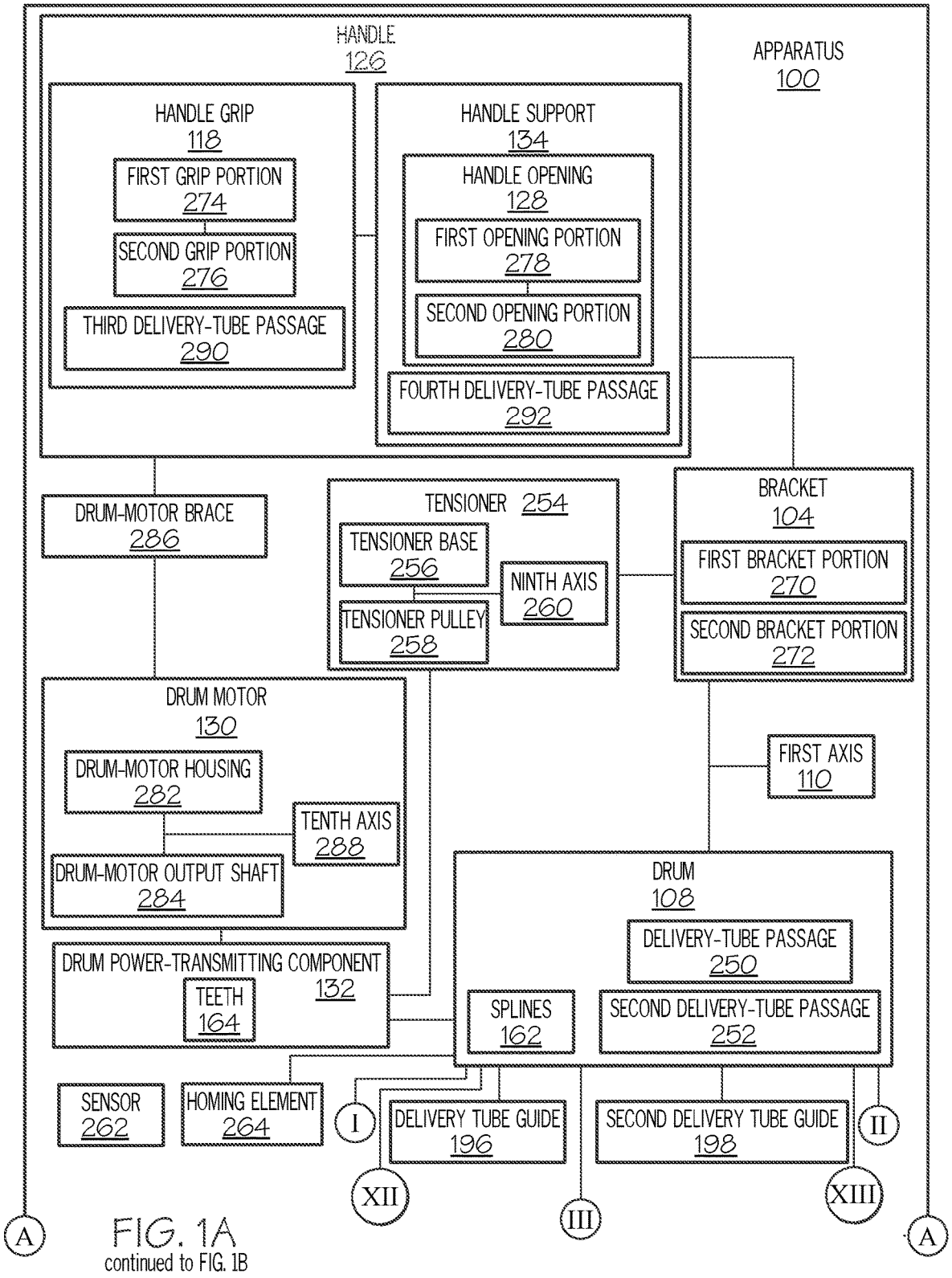
Figure 2:
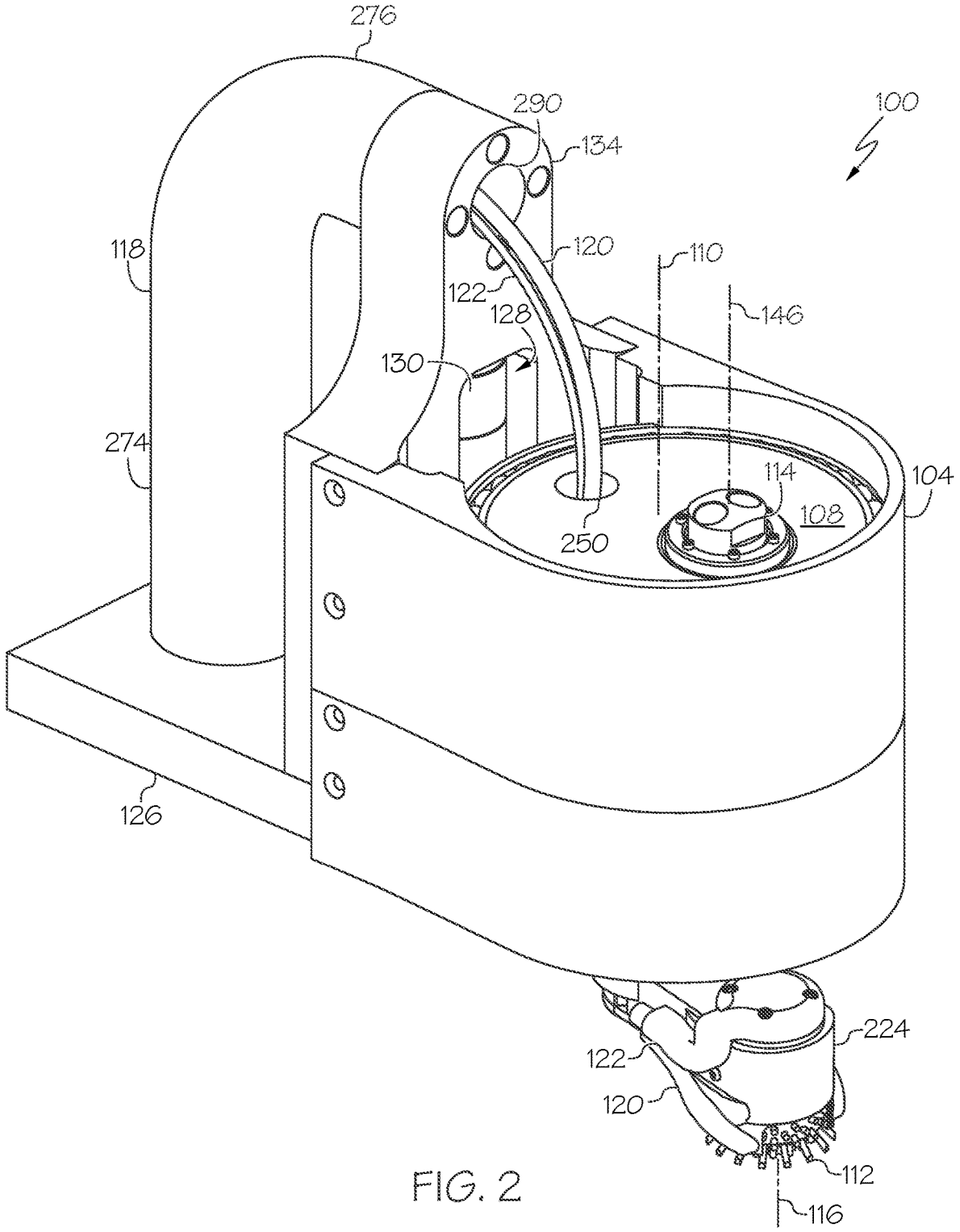
Figure 3:
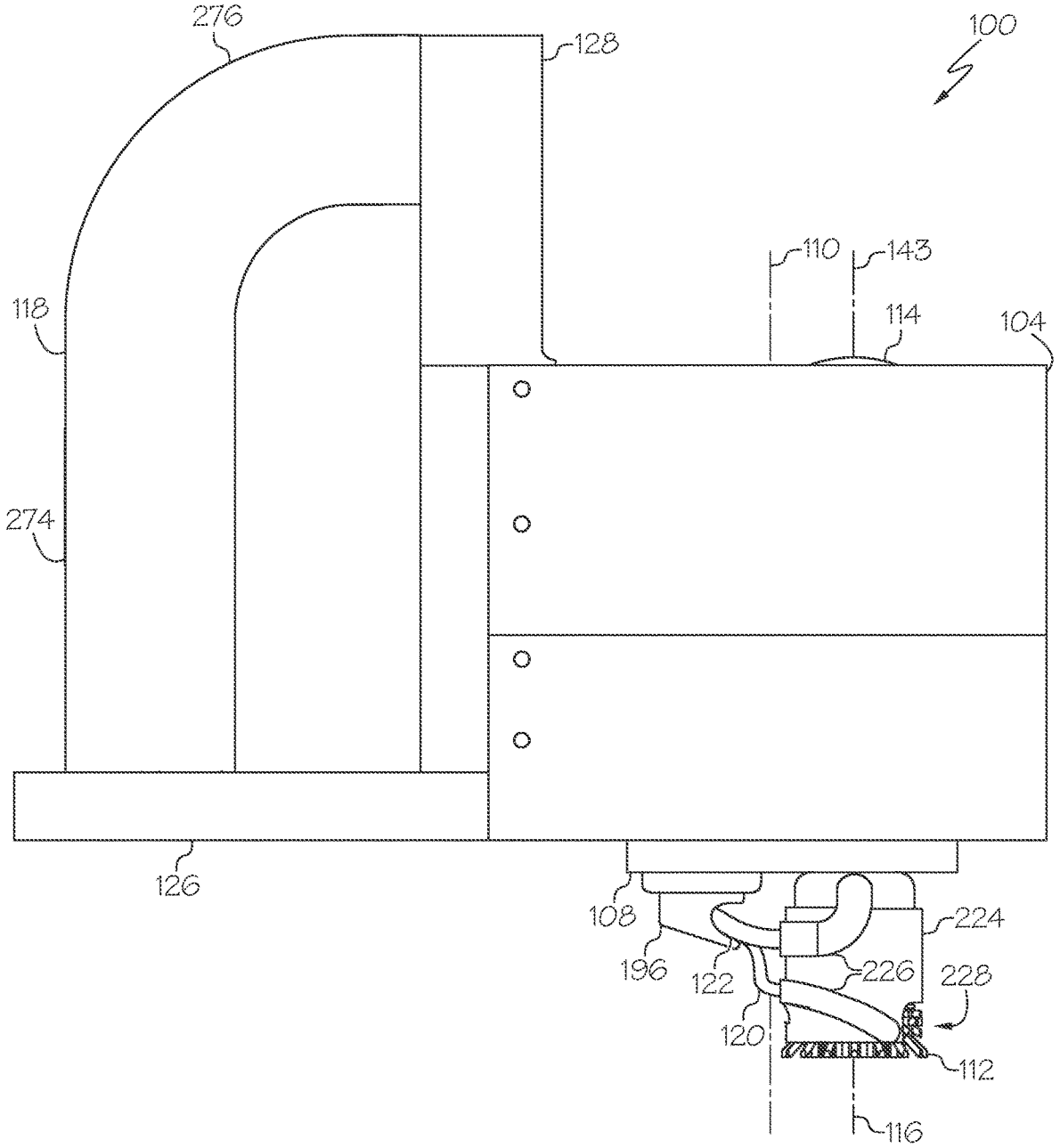
Figure 4:
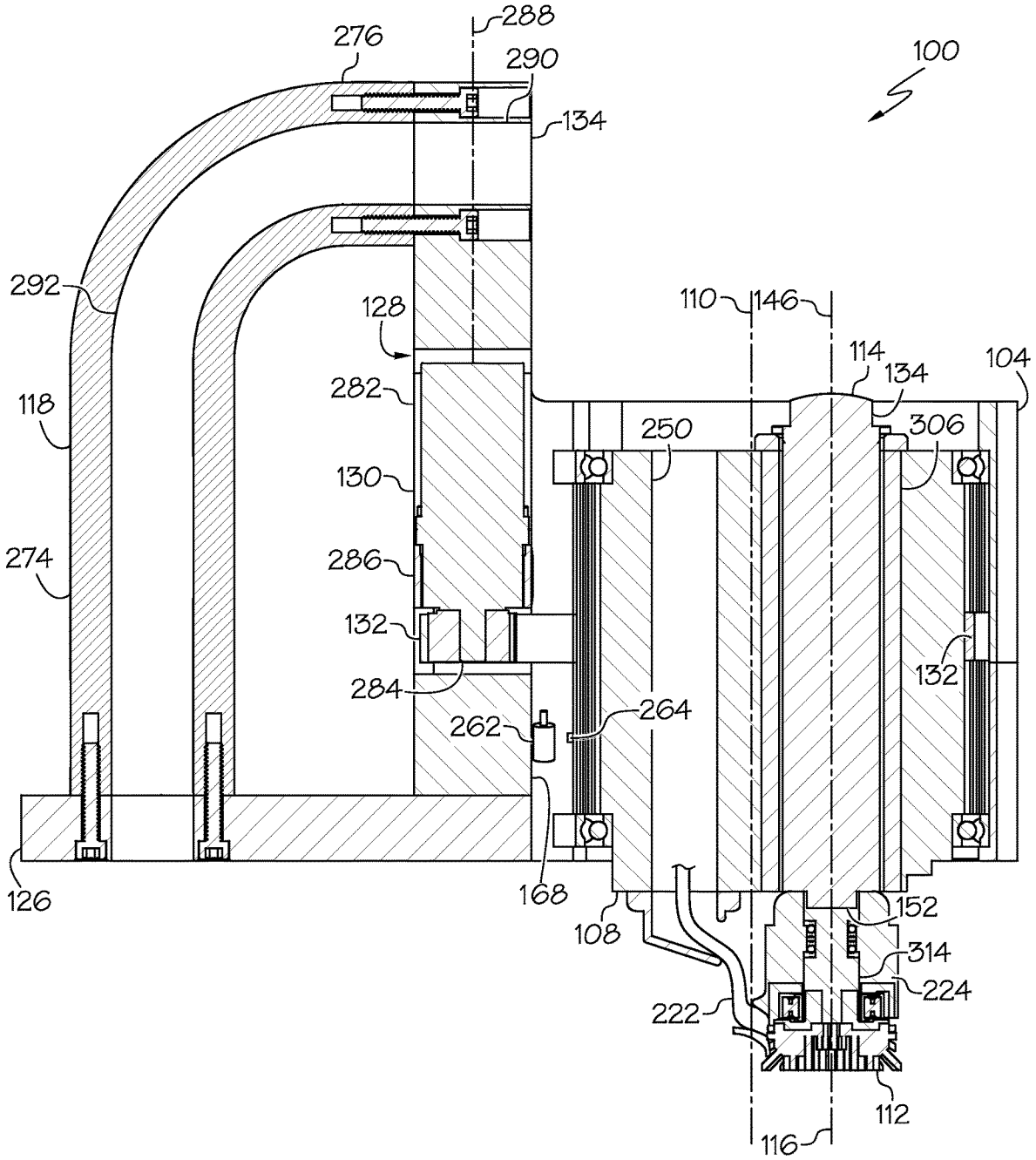
Figure 5:
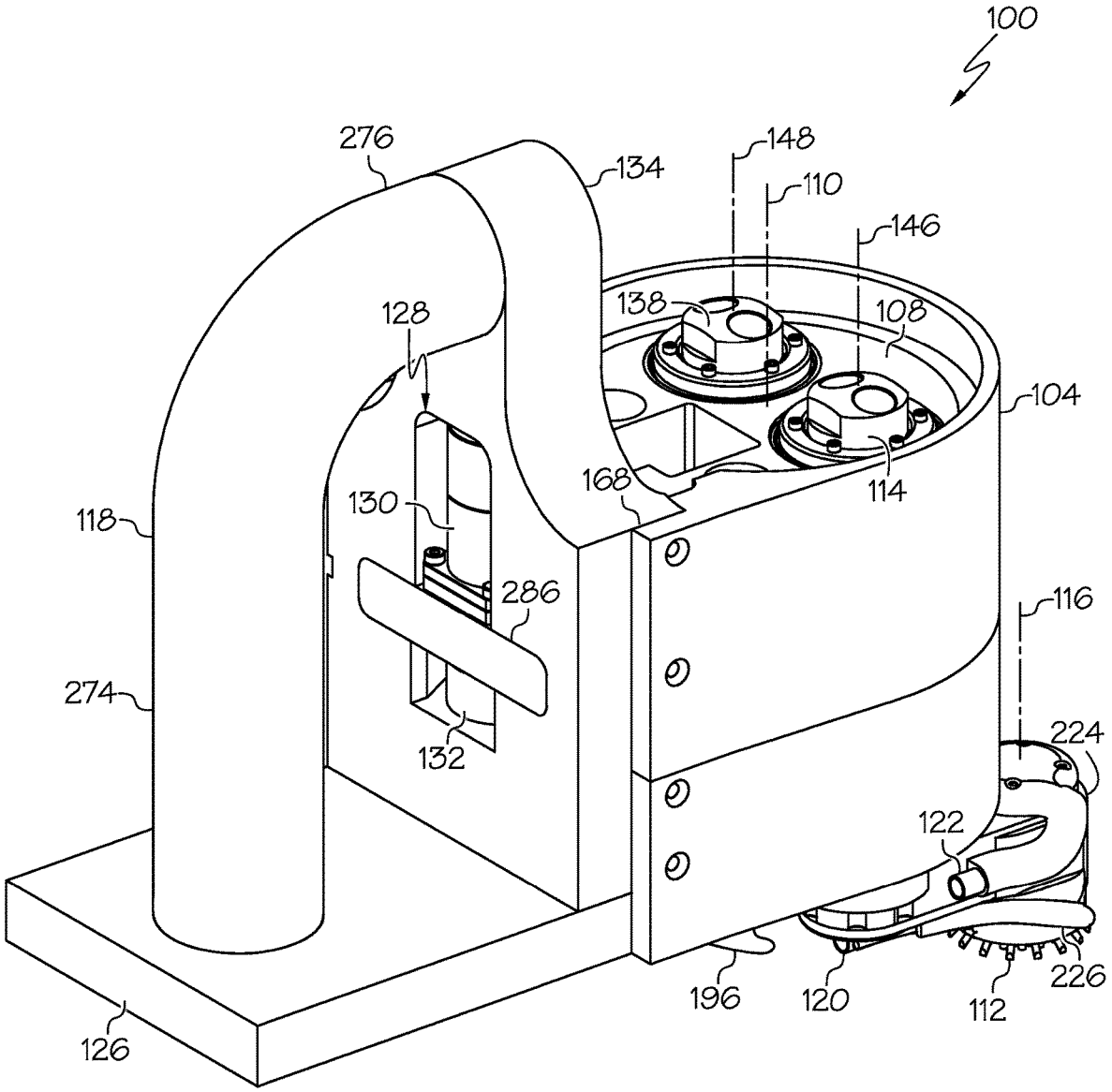
Figure 6:
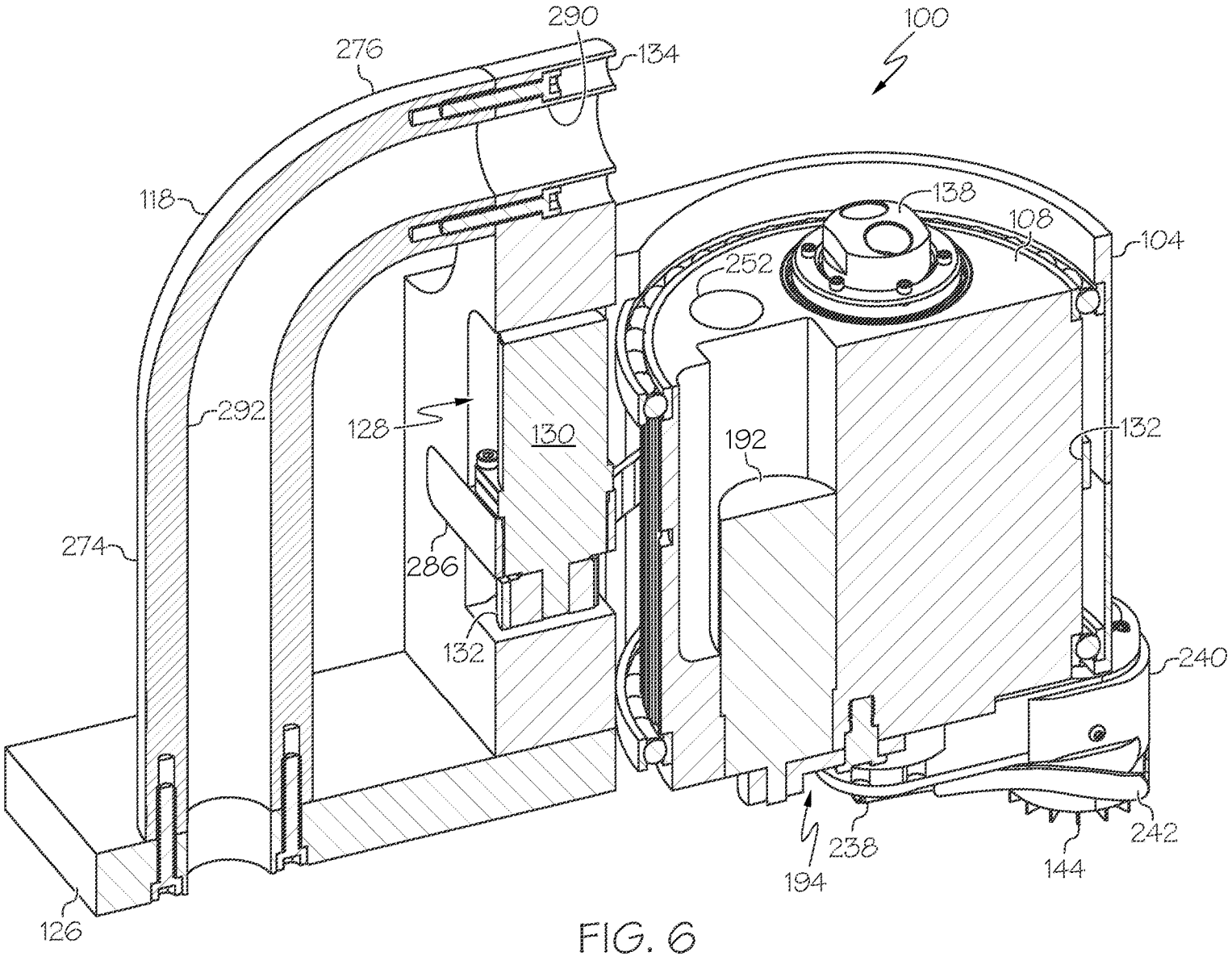
Figure 7:
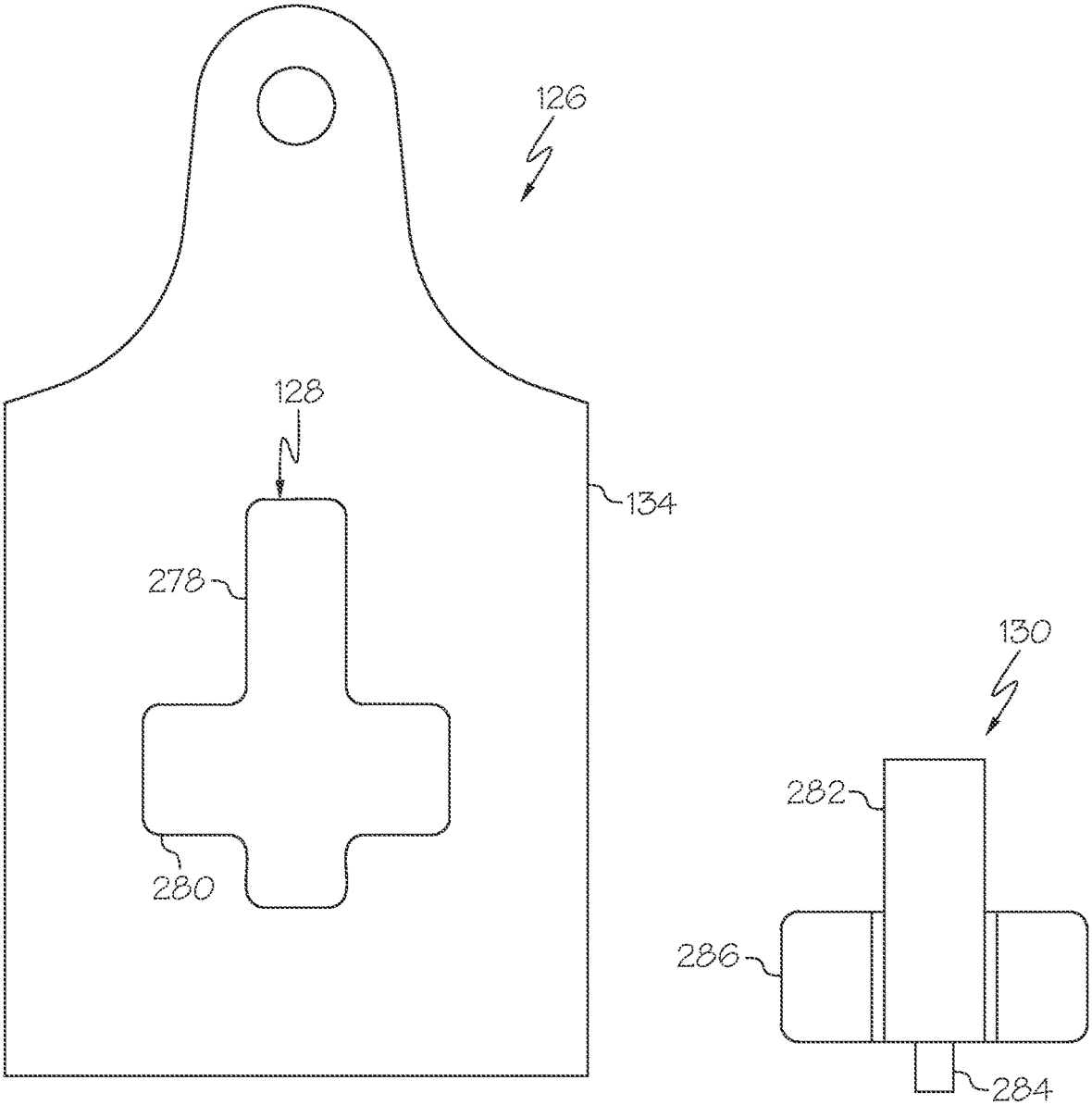
Figure 8:
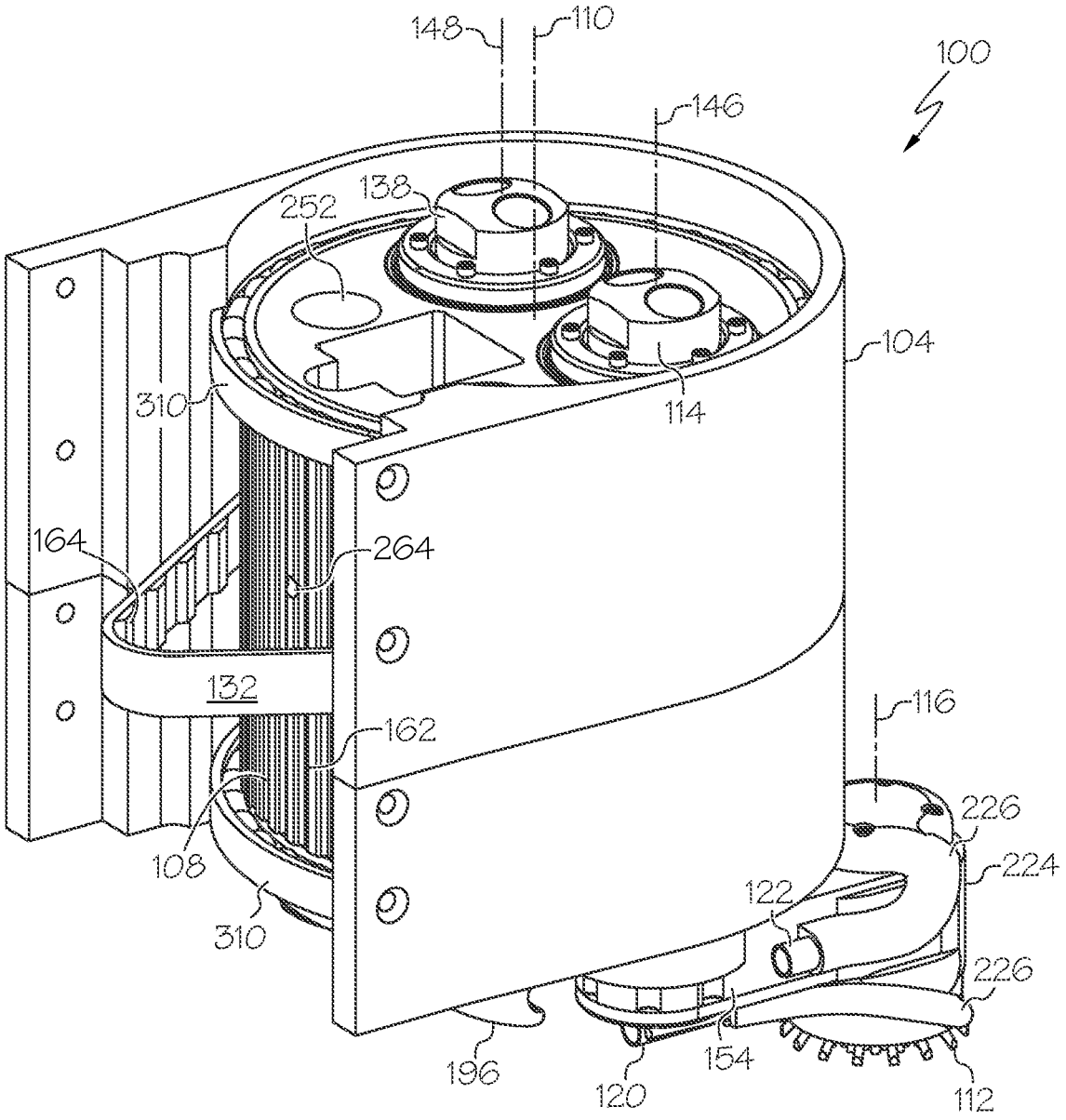
Figure 9:
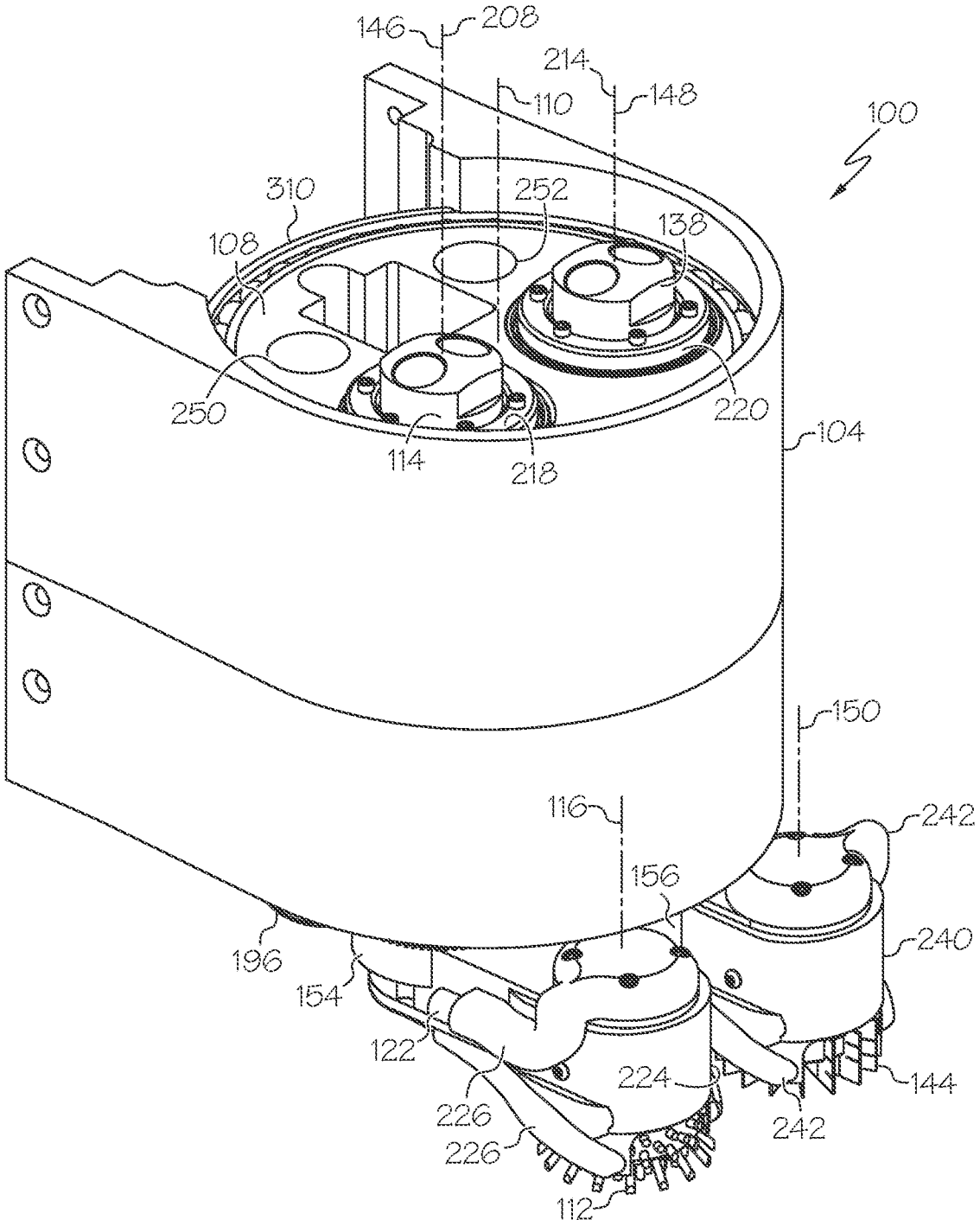
Figure 10:
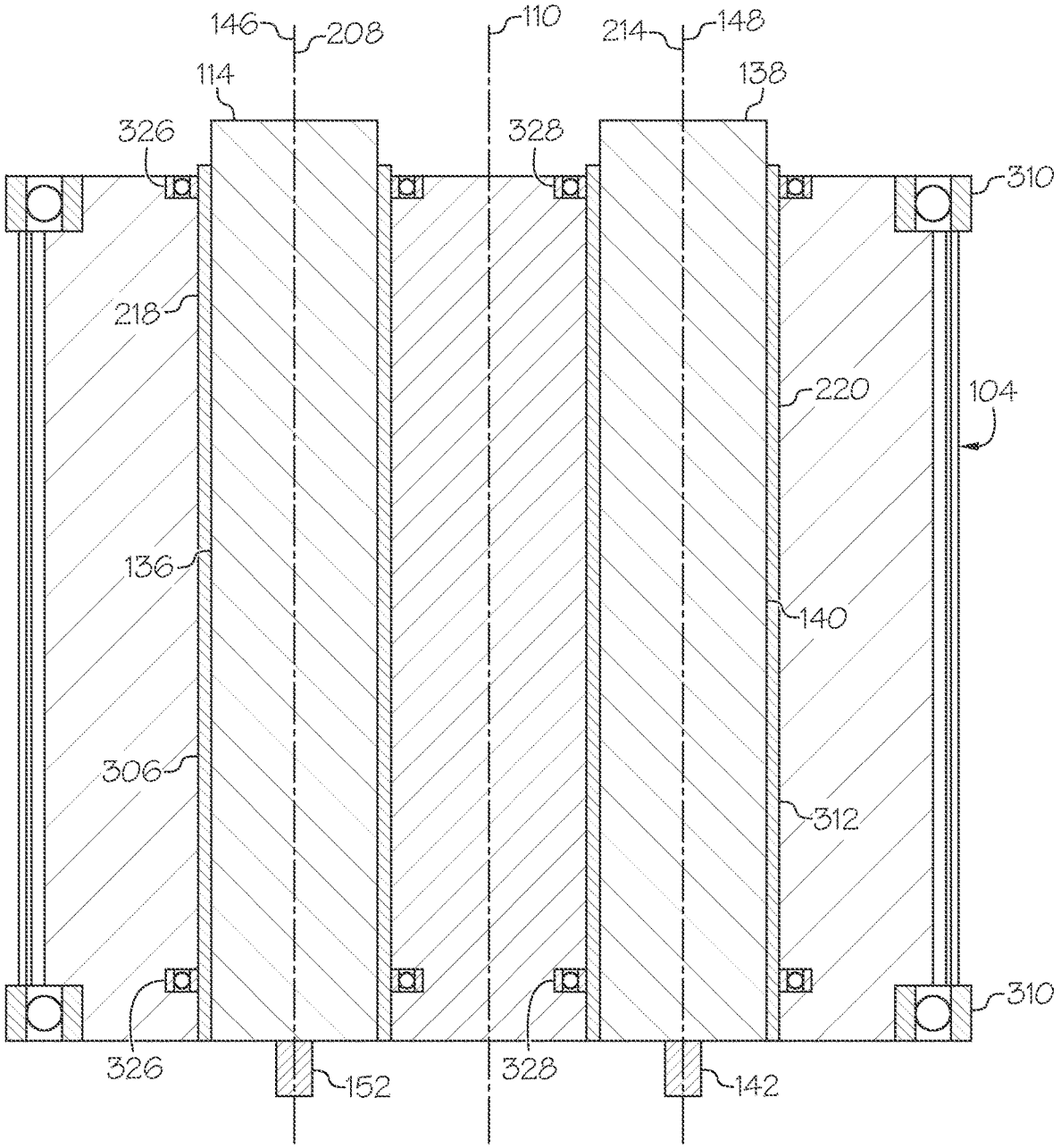
Figure 11:
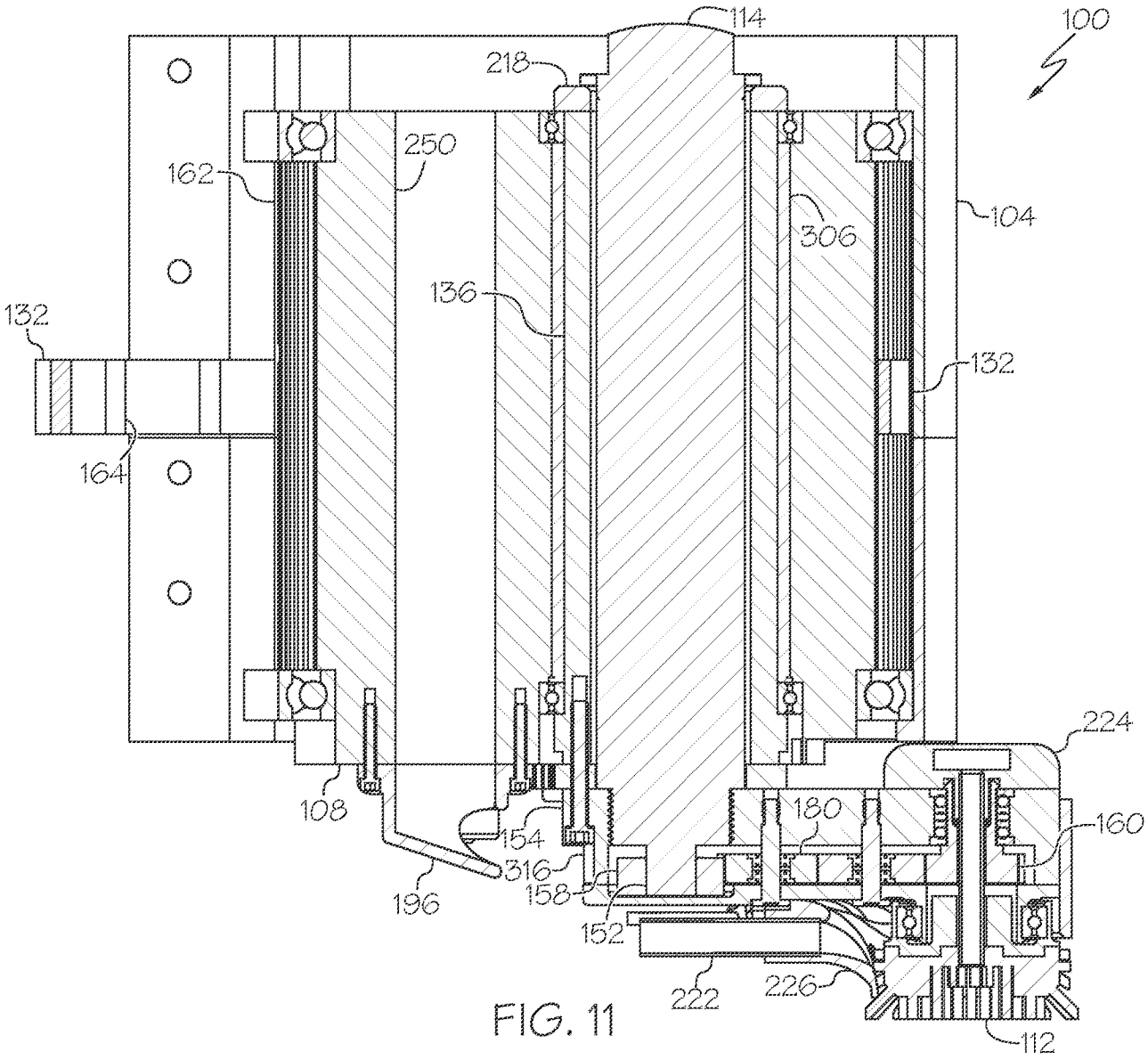
Figure 12:
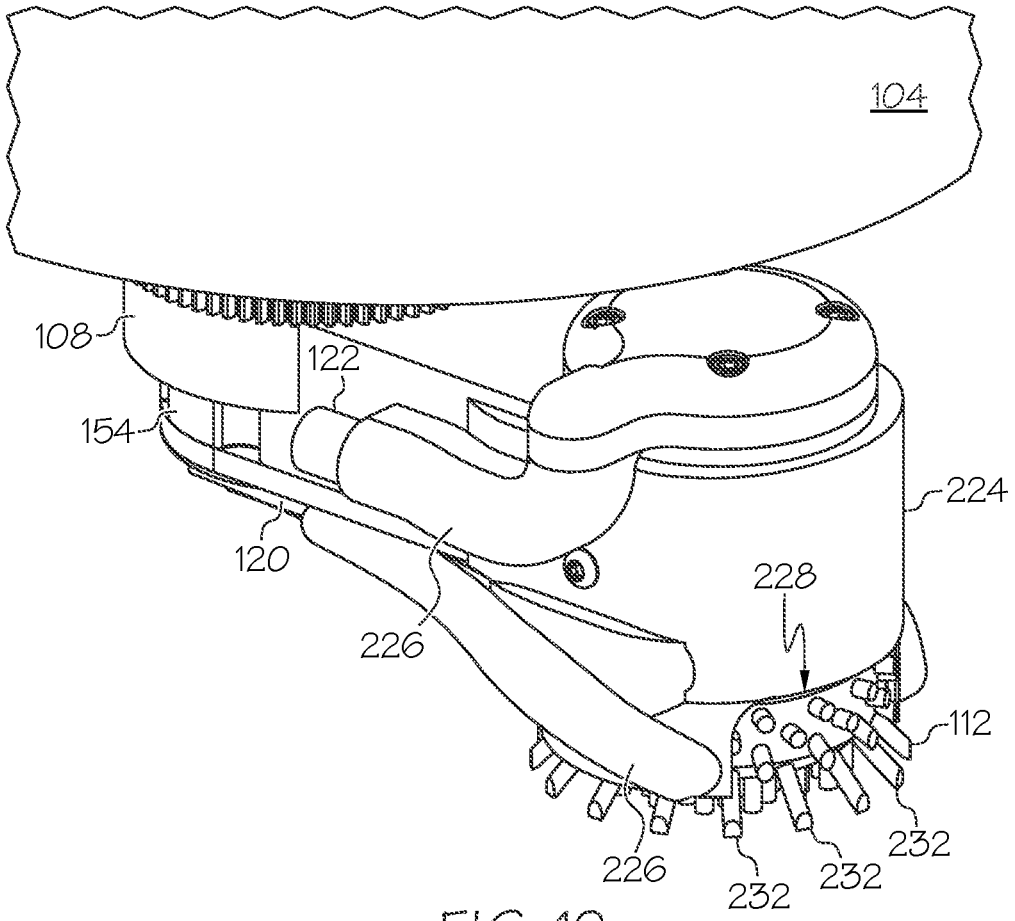
Figure 13:
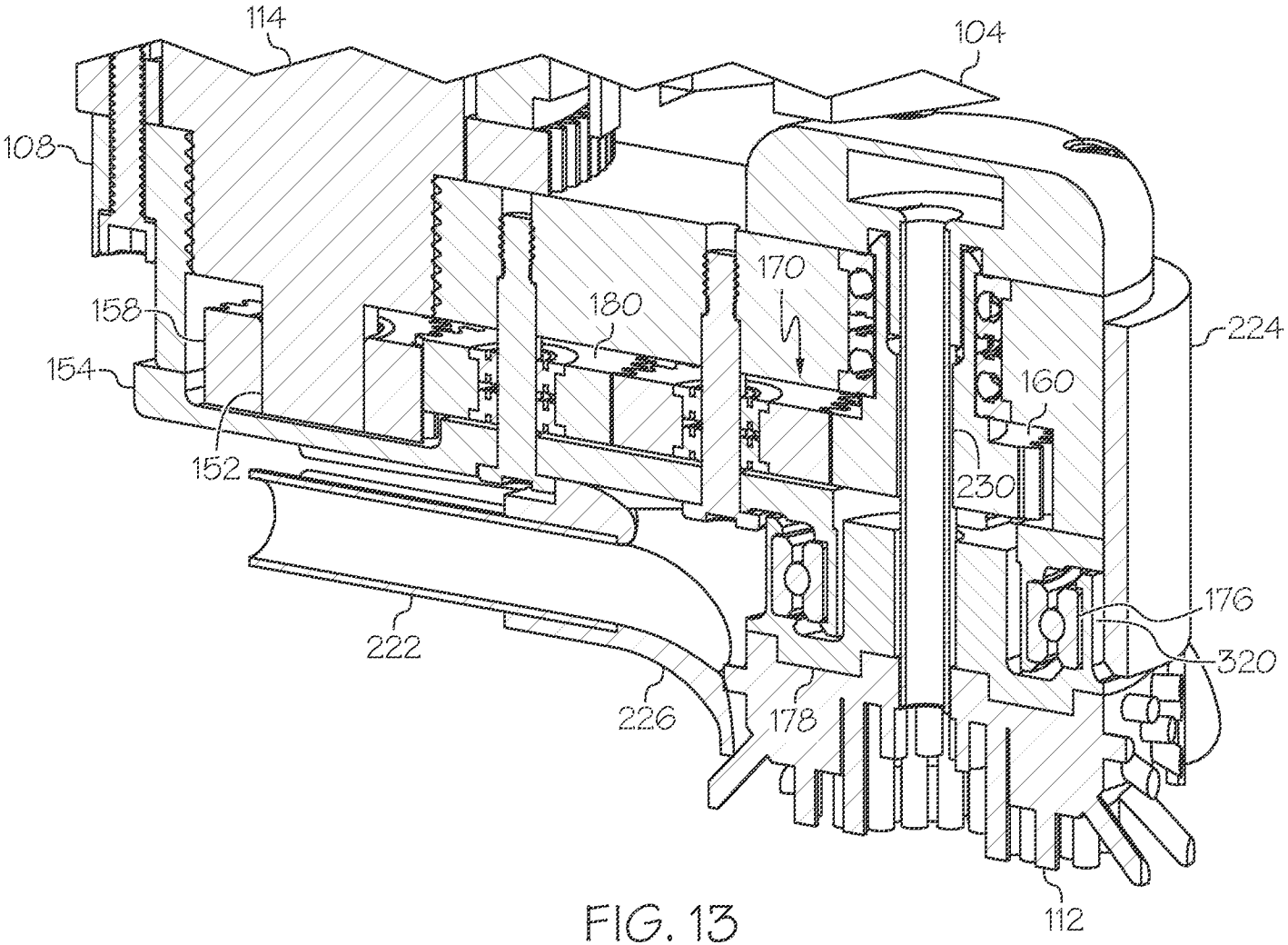
Figure 14:
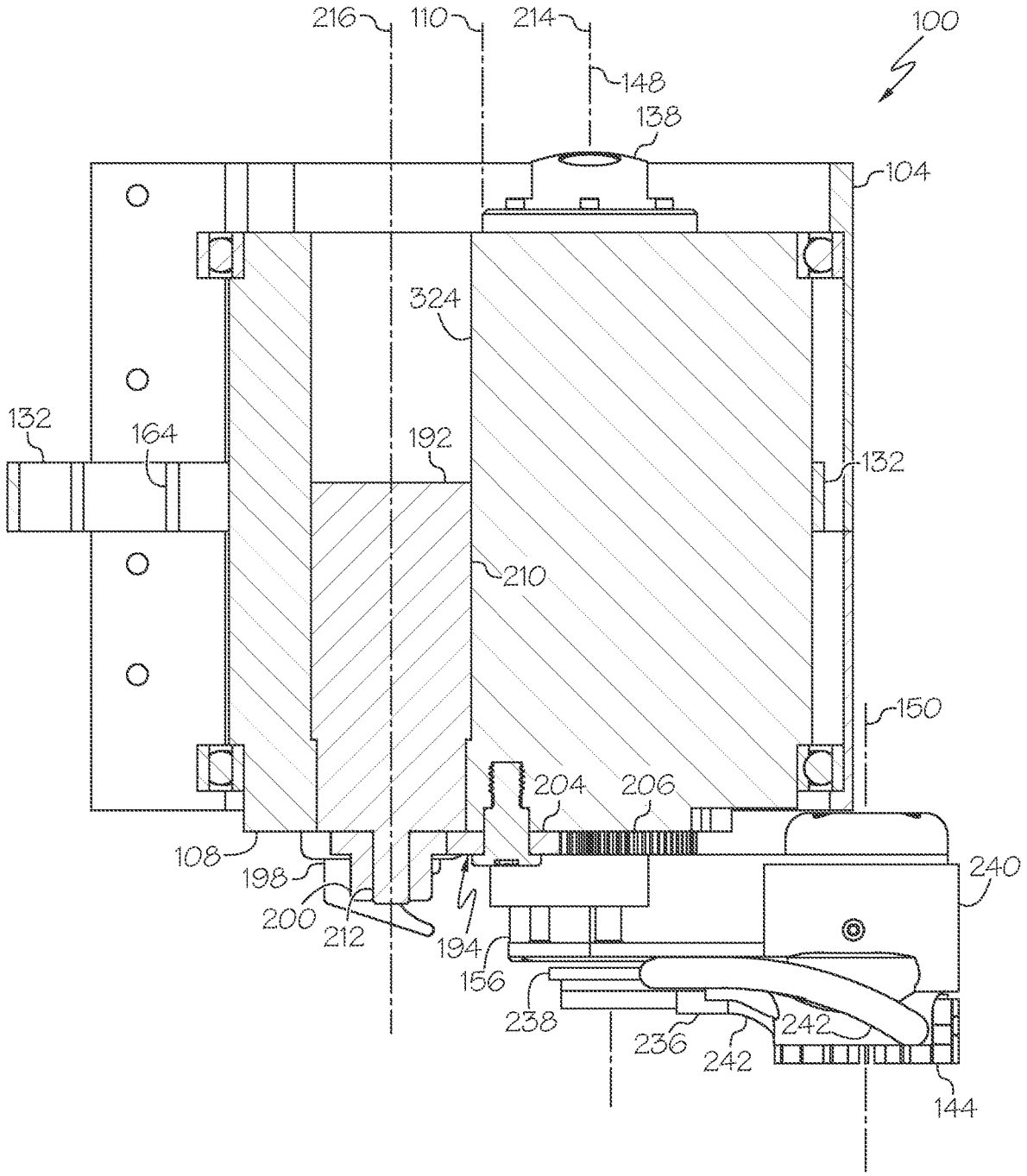
Figure 15:
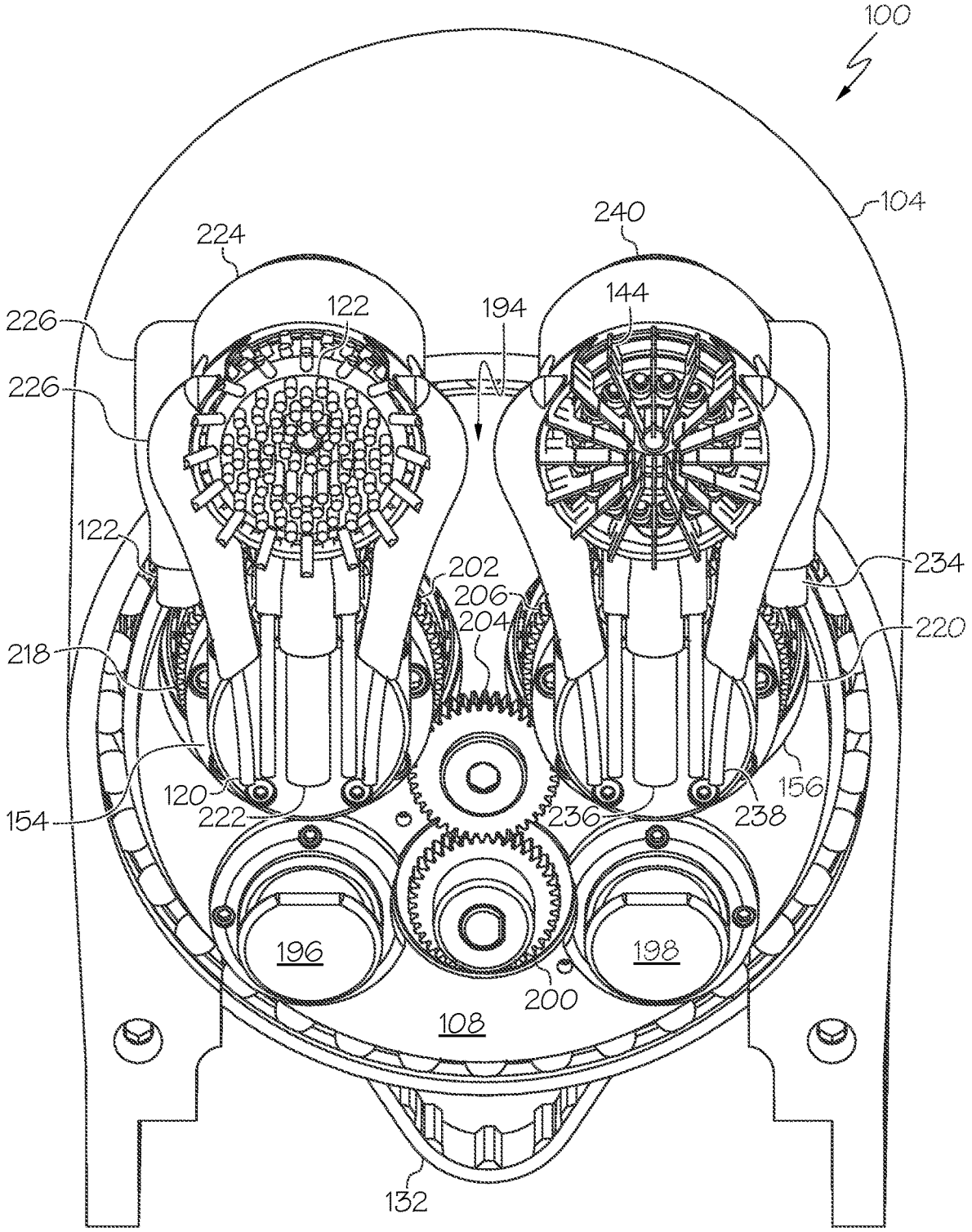
Figure 16:
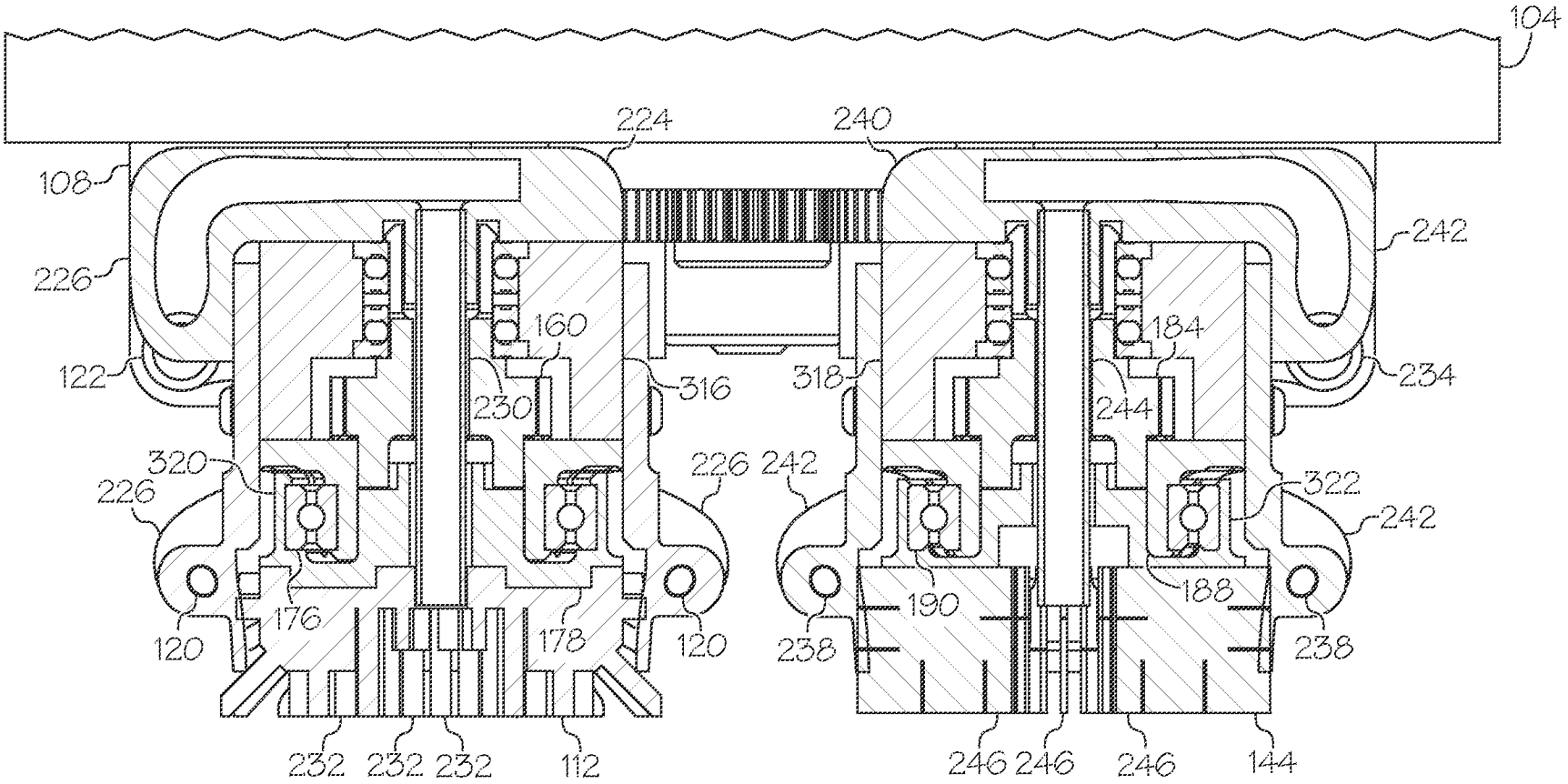
Figure 17:
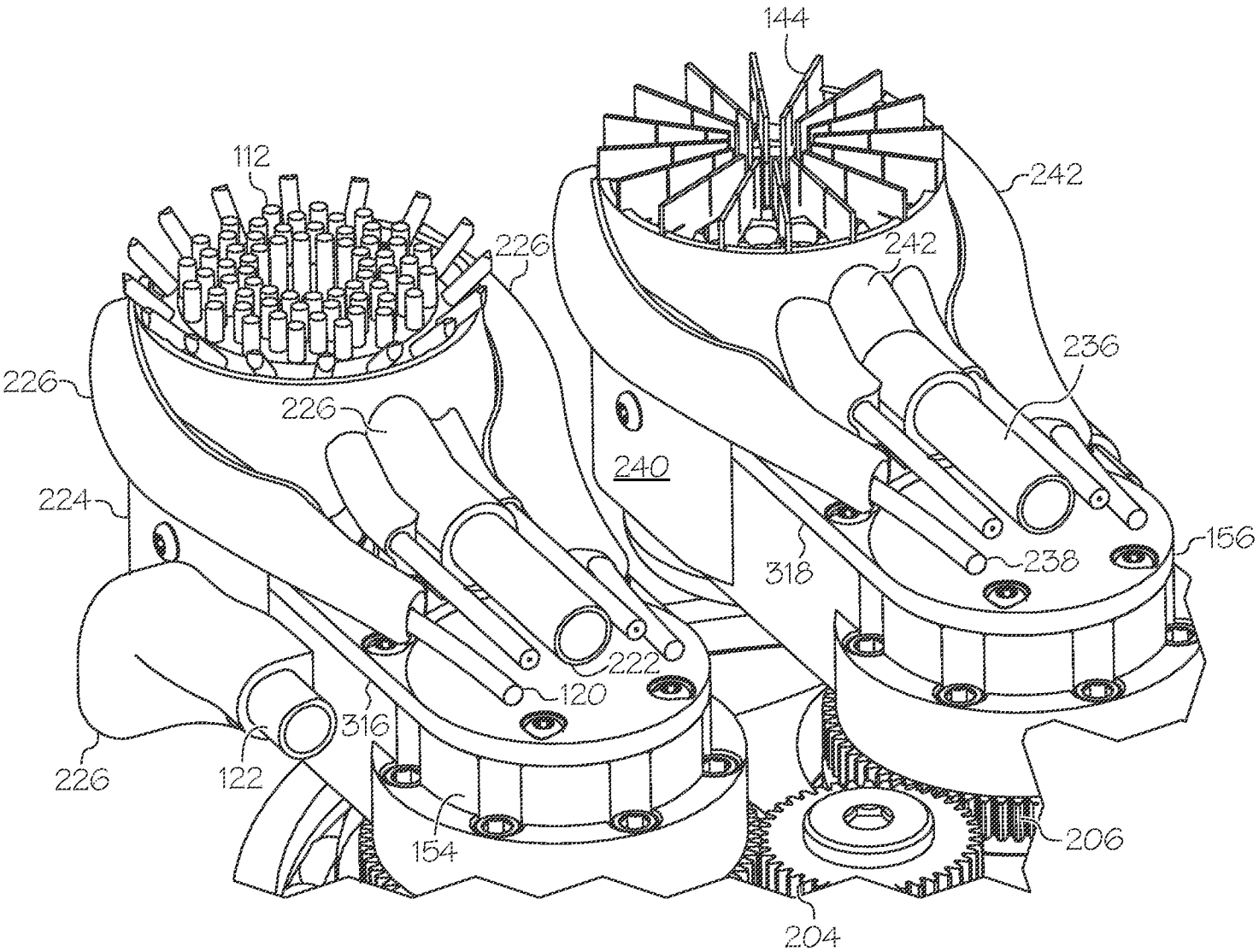
Figure 18:
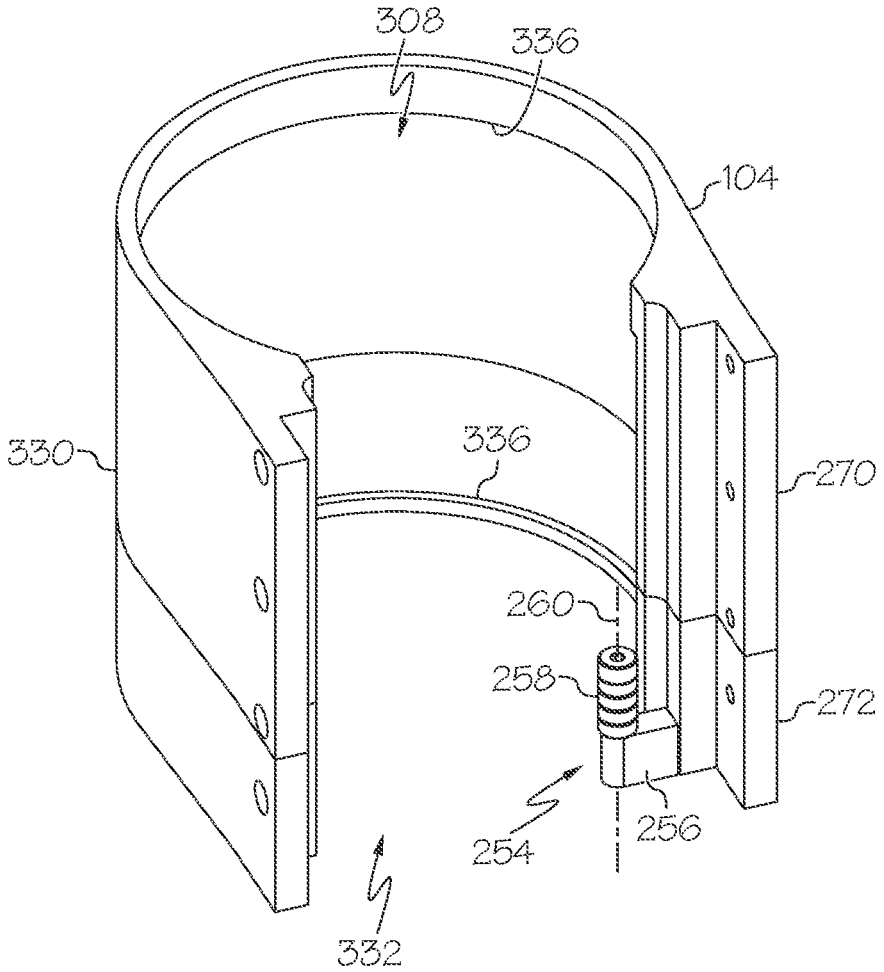
Figure 19:
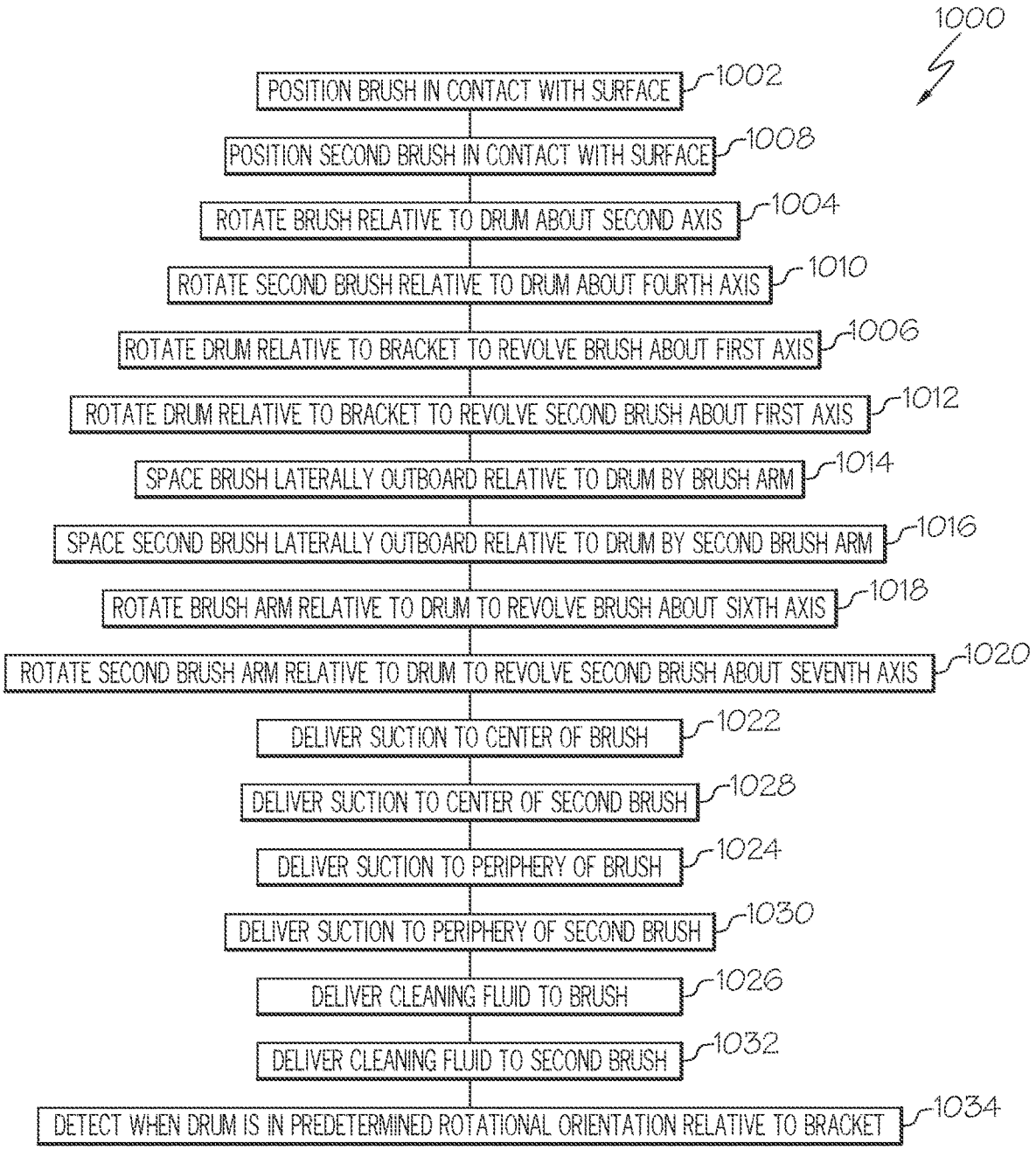
Figure 20:
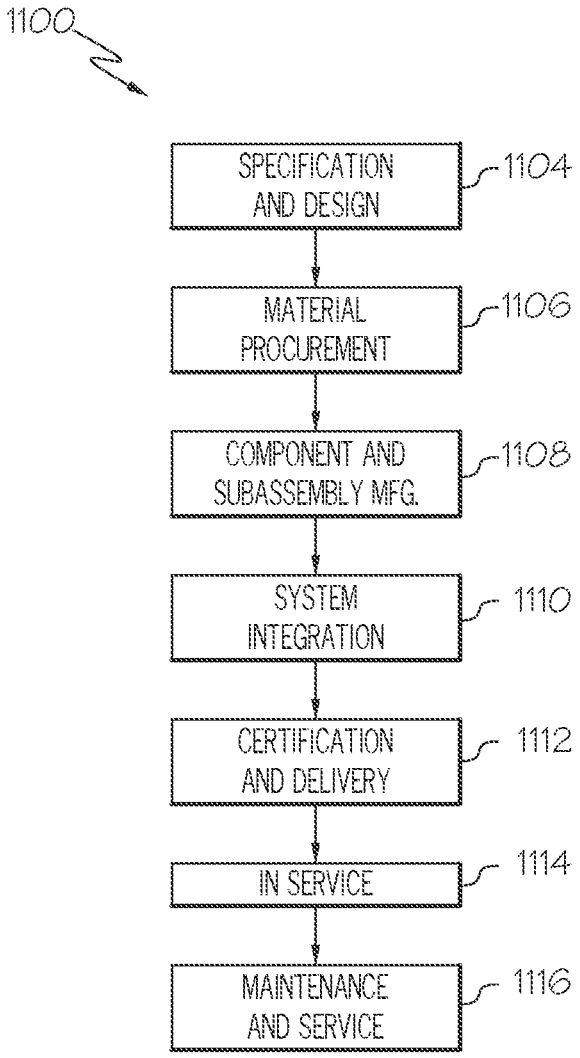
Figure 21:
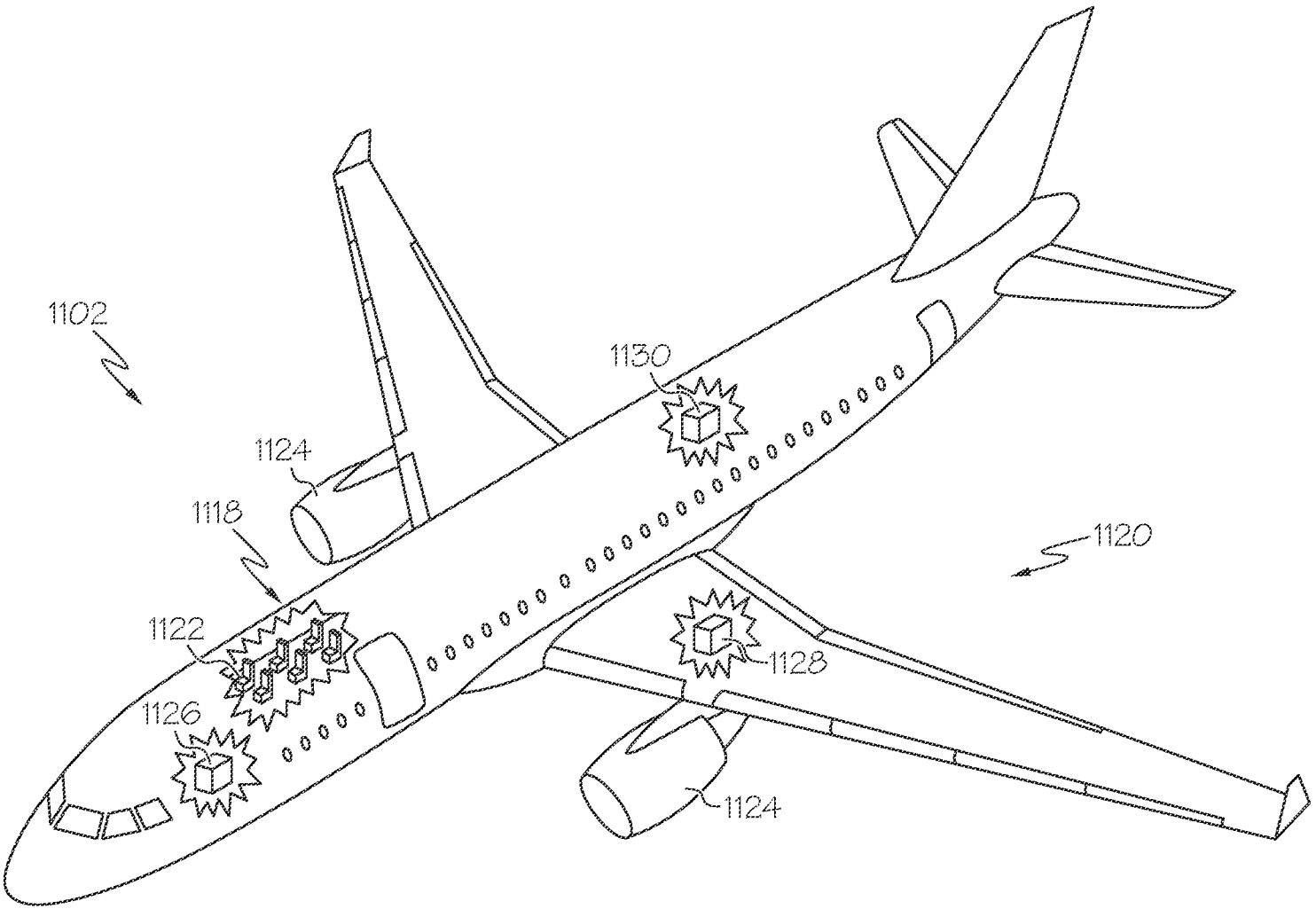

FIGS. 1A, 1B, 1C, and 1D, collectively, are a block diagram of an apparatus for cleaning a surface, according to one or more examples of the present disclosure;

FIG. 2 is a schematic, perspective view of the apparatus of FIGS. 1A, 1B, 1C, and 1D, attached to a robot, according to one or more examples of the present disclosure;

FIG. 3 is a schematic, elevation view of the apparatus of FIGS. 1A, 1B, 1C, and 1D, according to one or more examples of the present disclosure;

FIG. 4 is a schematic, elevation, sectional view of the apparatus of FIGS. 1A, 1B, 1C, and 1D, according to one or more examples of the present disclosure;

FIG. 5 is a schematic, perspective view of the apparatus of FIGS. 1A, 1B, 1C, and 1D, according to one or more examples of the present disclosure;

FIG. 6 is a schematic, perspective, sectional view of the apparatus of FIGS. 1A, 1B, 1C, and 1D, according to one or more examples of the present disclosure;

FIG. 7 is a schematic, elevation view of a handle and a drum motor of the apparatus of FIGS. 1A, and 1B, according to one or more examples of the present disclosure;

FIG. 8 is a schematic, perspective view of a sub-assembly of the apparatus of FIGS. 1A, 1B, 1C, and 1D, according to one or more examples of the present disclosure;

FIG. 9 is a schematic, perspective view of a sub-assembly of the apparatus of FIGS. 1A, 1B, 1C, and 1D, according to one or more examples of the present disclosure;

FIG. 10 is a schematic, elevation, sectional view of a drum of the apparatus of FIGS. 1A, 1B, 1C, and 1D, according to one or more examples of the present disclosure;

FIG. 11 is a schematic, elevation, sectional view of a sub-assembly of the apparatus of FIGS. 1A, 1B, 1C, and 1D, according to one or more examples of the present disclosure;

FIG. 12 is a schematic, partial, perspective view of a brush arm of the apparatus of FIGS. 1A, 1B, 1C, and 1D, according to one or more examples of the present disclosure;

FIG. 13 is a schematic, partial, perspective, sectional view of the brush arm of the apparatus of FIG. 12, according to one or more examples of the present disclosure;

FIG. 14 is a schematic, elevation, sectional view of a sub-assembly of the apparatus of FIGS. 1A, 1B, 1C, and 1D, according to one or more examples of the present disclosure;

FIG. 15 is a schematic, perspective view of a sub-assembly of the apparatus of FIGS. 1A, 1B, 1C, and 1D, according to one or more examples of the present disclosure;

FIG. 16 is a schematic, elevation, sectional view of the brush arm and a second brush arm of the apparatus of FIGS. 1A, 1B, 1C, and 1D, according to one or more examples of the present disclosure;

FIG. 17 is a schematic, partial, perspective view of the brush arm and the second brush arm of the apparatus of FIGS. 1A, 1B, 1C, and 1D, according to one or more examples of the present disclosure;

FIG. 18 is a schematic, perspective view of a bracket of the apparatus of FIGS. 1A, 1B, 1C, and 1D, according to one or more examples of the present disclosure;

FIG. 19 is a block diagram of a method of cleaning a surface utilizing the apparatus of FIGS. 1A, 1B, 1C, and 1D, according to one or more examples of the present disclosure;

FIG. 20 is a block diagram of aircraft production and service methodology; and FIG. 21 is a schematic illustration of an aircraft.

DETAILED DESCRIPTION

In FIGS. 1A, 1B, 1C, and 1D, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIGS. 1A, 1B, 1C, and 1D may be combined in various ways without the need to include other features described in FIGS. 1A, 1B, 1C, and 1D, other drawing figures, and/or the accompanying disclosure, even though such combination or combinations are not explicitly illustrated herein. Similarly, additional features not limited to the examples presented, may be combined with some or all of the features shown and described herein.

In FIGS. 19 and 20, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 19 and 20 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter according the present disclosure are provided below.

Referring generally to FIGS. 1A, 1B, 1C, and 1D and particularly to, e.g., FIGS. 2-18, apparatus 100 for cleaning surface 102 is disclosed. Apparatus 100 comprises handle 126 and bracket 104, connected to handle 126. Apparatus 100 further comprises drum 108, rotatably coupled to bracket 104 and rotatable about first axis 110 relative to bracket 104. Apparatus 100 also comprises drum motor 130, mounted to handle 126, and drum power-transmitting component 132, rotationally coupling drum motor 130 and drum 108. Apparatus 100 additionally comprises brush motor 114, mounted to drum 108, and brush 112, rotatable by brush motor 114 relative to drum 108 about second axis 116, which is parallel to first axis 110. The preceding subject matter of this paragraph characterizes example 1 of the present disclosure.

Apparatus 100 enables partially automated, manual cleaning of surface 102. Bracket 104 supports drum 108 and enables drum 108 to be connected to handle 126. Handle 126 enables manual control and position adjustment of apparatus 100 relative to surface 102. With brush 112 positioned in contact with surface 102, rotation of brush 112 relative to drum 108 about second axis 116 provides a first cleaning action to surface 102 (e.g., spinning brush 112 about second axis 116 on surface 102). With brush 112 positioned in contact with surface 102, rotation of drum 108 relative to bracket 104 about first axis 110 orbitally revolves brush 112 about first axis 110 relative to surface 102 along a cleaning path relative to surface 102 and provides a second cleaning action to surface 102 (e.g., orbitally revolving brush 112 about first axis 110 on surface 102). The configuration of drum 108, brush motor 114 and brush 112 beneficially reduces the overall size of apparatus 100 and enables apparatus 100 to clean surface 102 of a structure or other article, for example, located within a confined space.

Apparatus 100 delivers a reduction in the labor and time associated with surface cleaning operations of at least one surface of a structure. Apparatus 100 is capable of partially automated cleaning within a confined space, such as within a wing box of an aircraft.

As used herein, cleaning refers to removal of contaminants from surface 102, in particular, utilizing the cleaning actions of brush 112. As used herein, partially automated cleaning refers to manual positioning and movement of apparatus 100 to locate brush 112 relative to surface 102 (e.g., to be in contact with surface 102) and automated movement of brush 112 relative to handle 126 and to surface 102. As used herein, contaminants refer to any unwanted, foreign, or extraneous material located on or bonded to surface 102. In some examples, the contaminants include particulate material such as dirt, dust, material residue from a machining operation, or the like. In some examples, the contaminants include fluid material, such as cleaners, oils, coatings, adhesives, sealants, films, or the like.

As used herein, the cleaning actions of brush 112 include brushing, scrubbing, sweeping, wiping, sanding, polishing, or the like. The particular cleaning action of brush 112 depends, for example, on the type of brush 112, the material of brush 112, and/or the movement of brush 112.

The cleaning path of brush 112 relative to surface 102 depends, for example, on the rotational movement of drum 108 relative to bracket 104 about first axis 110. In some examples, drum 108 is fully rotatable (e.g., is capable of 360-degree rotation). In some examples, drum 108 is partially rotatable (e.g., is capable of less than 360-degree rotation). In some examples, drum 108 spins about first axis 110 in a first rotational direction (e.g., clockwise). In some examples, drum 108 oscillates between full or partial rotation about first axis 110 in the first rotational direction and a second rotational direction, opposite the first rotational direction (e.g., counter clockwise).

The cleaning path of brush 112 relative to surface 102 also depends, for example, on the cross-sectional shape of drum 108 as viewed along first axis 110. In some examples, drum 108 has a circular cross-sectional shape, as viewed along first axis 110, and the cleaning path of brush 112 is circular or semi-circular, for example, depending upon the rotation of drum 108. In some examples, drum 108 has an elliptical cross-sectional shape, as viewed along first axis 110, and the cleaning path of brush 112 is elliptical or semi-elliptical, for example, depending upon the rotation of drum 108.

Generally, apparatus 100 functions as a hand-held automated cleaning apparatus that is designed to interact with the environment by cleaning contaminants, located on surface 102. Drum 108 provides a supporting structure for mounting brush motor 114 and brush 112. In some examples, drum 108 includes drum opening 306 (FIGS. 4, 10, and 11) and brush motor 114 is at least partially located within drum opening 306. Bracket 104 provides a supporting structure for securely coupling drum 108 to handle 126. Rotation of drum 108 relative to bracket 104 about first axis 110 controls angular orientation of brush 112 relative to bracket 104 and surface 102 during the cleaning operation.

In some examples, bracket 104 includes bracket-opening 308 (FIG. 18) and drum 108 is at least partially located within bracket-opening 308. In some examples, first axis 110 defines an axis of rotation of drum 108 and a central axis of bracket-opening 308. In various examples, bracket 104 has any suitable shape that at least partially surrounds drum 108 and that is configured to retain drum 108. In various examples, drum 108 is coupled to bracket 104 in any manner suitable to enable rotation of drum 108 relative to bracket 104 about first axis 110. In some examples, apparatus 100 also includes one or more annular bearings 310 (FIGS. 5-8) that are coupled to an exterior of drum 108. In an example, a first one of annular bearings 310 is located at one (e.g., a first) end of drum 108 and a second one of annular bearings 310 is located at the other (e.g., a second) end of drum 108.

Throughout the present disclosure, the term "parallel" refers to an orientation between items extending in approximately the same direction.

Referring generally to FIGS. 1A, 1B, 1C, and 1D and particularly to, e.g., FIGS. 6,7, and 13-15, apparatus 100 further comprises second brush motor 138, mounted to drum 108, and second brush 144, rotatable by second brush motor 138 relative to drum 108 about fourth axis 150, which is parallel to first axis 110 and second axis 116. The preceding subject matter of this paragraph characterizes example 2 of the present disclosure, wherein example 2 also includes the subject matter according to example 1, above.

With second brush 144 positioned in contact with surface 102, rotation of second brush 144 relative to drum 108 provides a third cleaning action to surface 102 (e.g., spinning second brush 144 about fourth axis 150 on surface 102). With second brush 144 positioned in contact with surface 102, rotation of drum 108 relative to bracket 104 about first axis 110 orbitally revolves second brush 144 about first axis 110 relative to surface 102 along a second cleaning path relative to surface 102 and provides a fourth cleaning action to surface 102 (e.g., orbitally revolving second brush 144 about first axis 110 on surface 102). The configuration of drum 108, second brush motor 138 and second brush 144 beneficially reduces the overall size of apparatus 100 and enables apparatus 100 to clean surface 102 of a structure or other article, for example, located within a confined space.

As used herein, cleaning also refers to removal of contaminants from surface 102, in particular, utilizing the cleaning actions of second brush 144. As used herein, partially automated cleaning also refers to manual positioning and movement of apparatus 100 to locate second brush 144 relative to surface 102 (e.g., to be in contact with surface 102) and automated movement of second brush 144 relative to handle 126 and to surface 102. As used herein, the cleaning actions of second brush 144 include brushing, scrubbing, sweeping, wiping, sanding, polishing, or the like.

The particular cleaning action of second brush 144 depends, for example, on the type of second brush 144, the material of second brush 144, and/or the movement of second brush 144. Like for brush 112, the second cleaning path of second brush 144 relative to surface 102 depends, for example, on the rotational movement of drum 108 relative to bracket 104 about first axis 110 and on the cross-sectional shape of drum 108, as viewed along first axis 110. In some examples, the second cleaning path of second brush 144 is circular or semi-circular, for example, depending upon the rotation of drum 108. In some examples, the second cleaning path of second brush 144 is elliptical or semi-elliptical, for example, depending upon the rotation of drum 108.

Drum 108 also provides a supporting structure for mounting second brush motor 138 and second brush 144. In some examples, drum 108 includes second drum opening 312 (FIG. 8) and second brush motor 138 is at least partially located within second drum opening 312. Rotation of drum 108 relative to bracket 104 about first axis 110 controls angular orientation of second brush 144 relative to bracket 104 and surface 102 during the cleaning operation.

Drum motor 130 and drum power-transmitting component 132 enable automated, precise rotation of drum 108 relative to bracket 104 about first axis 110. Control of drum motor 130 enables rotation of drum 108. Drum motor 130 is operatively coupled with drum power-transmitting component 132. Drum power-transmitting component 132 is operatively coupled with drum 108. Drum power-transmitting component 132 transmits rotational motion of drum motor 130 to drum 108. Controlled selective rotary motion of drum 108 relative to bracket 104 selectively adjusts rotational orientation of drum 108 about first axis 110 relative to bracket 104 and selective adjustment of angular orientation of brush 112, or of brush 112 and second brush 144, relative to bracket 104 and relative to surface 102.

Referring generally to FIGS. 1A, 1B, 1C, and 1D and particularly to, e.g., FIGS. 2-7, handle 126 comprises handle grip 118 and handle support 134, connected to handle grip 118 and having handle opening 128. Drum motor 130 is located at least partially within handle opening 128. The preceding subject matter of this paragraph characterizes example 3 of the present disclosure, wherein example 3 also includes the subject matter according to example 2, above.

Handle grip 118 enables manual manipulation of apparatus 100 in order to control a position of brush 112, or of brush 112 and second brush 144, relative to surface 102. Handle support 134 provides a supporting structure for connection of bracket 104 to handle 126. Handle support 134 also provides a supporting structure for connection of drum motor 130, which is removably connected to handle support 134. Handle opening 128 provides a mounting location that receives drum motor 130 during connection of drum motor 130 to handle support 134 and enables drum power-transmitting component 132 to access drum 108.

In an example, with drum motor 130 connected to handle support 134, at least a portion of drum motor 130 is located within handle opening 128. Drum power-transmitting component 132 is operatively coupled with drum motor 130 and extends from within handle opening 128 to be coupled to drum 108.

Referring generally to FIGS. 1A, 1B, 1C, and 1D and particularly to, e.g., FIGS. 2-6, handle grip 118 comprises first grip portion 274, oriented parallel to first axis 110, and second grip portion 276, oriented perpendicular to first axis 110. The preceding subject matter of this paragraph characterizes example 4 of the present disclosure, wherein example 4 also includes the subject matter according to example 3, above.

First grip portion 274 enables manual manipulation of apparatus 100 in directions approximately perpendicular to first axis 110 (e.g., forward and backward). Second grip portion 276 enables manual manipulation of apparatus 100 in directions approximately parallel to first axis 110 (e.g., up and down).

Referring generally to FIGS. 1A, 1B, 1C, and 1D and particularly to, e.g., FIGS. 4 and 6, drum 108 is selectively rotatable relative to bracket 104. The preceding subject matter of this paragraph characterizes example 5 of the present disclosure, wherein example 5 also includes the subject matter according to example 3 or 4, above.

Selective rotation of drum 108 relative to bracket 104 enables selective control and adjustment of an angular orientation of brush 112, or of brush 112 and second brush 144, about first axis 110 relative to bracket 104 and selective control and adjustment of a position of brush 112, or of brush 112 and second brush 144, relative to surface 102.

Selective adjustability of the angular orientation of brush 112, or of brush 112 and second brush 144, relative to bracket 104 positions brush 112, or brush 112 and second brush 144, in any one of numerous positions about first axis 110 relative to bracket 104 and surface 102. Angular adjustment of brush 112, or of brush 112 and second brush 144, relative to surface 102 enables cleaning of various areas of surface 102 without having to change the position of apparatus 100.

Referring generally to FIGS. 1A, 1B, 1C, and 1D and particularly to, e.g., FIG. 4, drum motor 130 comprises drum-motor housing 282 and drum-motor output shaft 284, rotatable relative to drum-motor housing 282 about tenth axis 288, which is parallel to first axis 110. Drum power-transmitting component 132 is operatively coupled with drum-motor output shaft 284. The preceding subject matter of this paragraph characterizes example 6 of the present disclosure, wherein example 6 also includes the subject matter according to example 5, above.

Drum power-transmitting component 132 enables drum-motor output shaft 284 of drum motor 130 to transmit rotational motion from drum motor 130 to drum 108 such that drum 108 spins about first axis 110.

Drum-motor output shaft 284 is rotatable by drum motor 130 to produce a rotary force or torque when drum motor 130 is operated. In some examples, drum motor 130 is any one of various rotational motors, such as an electric motor, a hydraulic motor, a pneumatic motor, or the like.

Drum power-transmitting component 132 provides an efficient and reliable mechanism to transmit power from drum motor 130 to drum 108, such as when first axis 110 is not co-axial with an axis of rotation of drum motor 130. In an example, drum power-transmitting component 132 is a belt, operatively coupled with the fourth output shaft of drum motor 130. In other examples, drum power-transmitting component 132 is any one of a chain, a gear, a gear train, or the like. Advantageously, the belt is lighter and cleaner than other implementations of drum power-transmitting component 132; for example, the belt does not require lubrication for effective operation.

In some examples, apparatus 100 also includes one or more other transmission components, configured to operatively couple drum motor 130 with drum power-transmitting component 132, including, but not limited to, gears, belts, sprockets, or the like. In an example, drum motor 130 also includes a drive gear or drive sprocket, connected to the fourth output shaft of drum motor 130 and operatively coupled with drum power-transmitting component 132.

In an example, drum-motor housing 282 is connected to handle support 134. At least a portion of drum-motor housing 282 is located within handle opening 128. Drum power-transmitting component 132 is operatively coupled with drum-motor output shaft 284 and extends from within handle opening 128 to be coupled to drum 108.

Referring generally to FIGS. 1A, 1B, 1C, and 1D and particularly to, e.g., FIGS. 4-7, apparatus 100 further comprises drum-motor brace 286, connected to drum-motor housing 282 and to handle support 134. The preceding subject matter of this paragraph characterizes example 7 of the present disclosure, wherein example 7 also includes the subject matter according to example 6, above.

Drum-motor brace 286 retains drum motor 130 in connection with handle support 134 and supports drum-motor housing 282 within handle opening 128.

In an example, drum-motor brace 286 has a shape that is geometrically complementary to a shape of a portion of handle opening 128. Drum-motor brace 286 is received by handle opening 128 and engages handle support 134 to connect drum-motor housing 282 and handle support 134 together.

Referring generally to FIGS. 1A, 1B, 1C, and 1D and particularly to, e.g., FIGS. 4-7, handle opening 128 comprises first opening portion 278, oriented parallel to first axis 110, and second opening portion 280, oriented perpendicular to first axis 110 and at least partially intersecting first opening portion 278. Drum-motor housing 282 is located within first opening portion 278 of handle opening 128. Drum-motor brace 286 is mounted within second opening portion 280 of handle opening 128. The preceding subject matter of this paragraph characterizes example 8 of the present disclosure, wherein example 8 also includes the subject matter according to example 7, above.

First opening portion 278 accommodates locating drum motor 130 and a portion of drum power-transmitting component 132 within handle opening 128 and enables drum power-transmitting component 132 to access drum motor 130. Second opening portion 280 enables engagement (e.g., insertion) of drum-motor brace 286 to retain drum motor 130.

In an example, drum-motor brace 286 has a shape that is geometrically complementary to a shape of second opening portion 280 of handle opening 128. Drum-motor brace 286 is received by second opening portion 280 and engages handle support 134 to support drum-motor housing 282 within first opening portion 278 and connect drum-motor housing 282 and handle support 134 together.

Referring generally to FIGS. 1A, 1B, 1C, and 1D and particularly to, e.g., FIGS. 5, 8, and 9, brush motor 114 comprises brush-motor housing 136 and brush-motor output shaft 152, rotatable relative to brush-motor housing 136 about third axis 146, which is parallel to first axis 110. Brush 112 is operatively coupled with brush-motor output shaft 152. The preceding subject matter of this paragraph characterizes example 9 of the present disclosure, wherein example 9 also includes the subject matter according to any one of examples 3 to 8, above.

Brush-motor output shaft 152 of brush motor 114 transmits rotational motion from brush motor 114 to brush 112 such that brush 112 spins about second axis 116.

In some examples, brush-motor housing 136 is located within drum opening 306 and is connected to drum 108. In some examples, brush-motor output shaft 152 of brush motor 114 extends from drum 108 to be operatively coupled with brush 112. In various examples, brush-motor output shaft 152 is rotatable by brush motor 114 to produce a rotary force or torque when brush motor 114 is operated. In an example, brush motor 114 is a rotary pneumatic motor, operatively coupled to and controlled by a pressure source (not shown). A pneumatic motor beneficially facilitates a simple and cost-effective way of spinning brush 112 about second axis 116. In various other examples, brush motor 114 is any one of various rotational motors, such as an electric motor, a hydraulic motor, or the like. In some examples, apparatus 100 also includes a controller (not shown), operatively coupled with the pressure source to control application of pneumatic pressure to brush motor 114.

In some examples, the controller includes (or is) at least one electronic controller (e.g., a programmable processor) and at least one control valve that is pneumatically coupled to the pressure source and brush motor 114. The controller is configured to control application of pneumatic pressure from the pressure source to brush motor 114. In some examples, the control valve is a two-way valve. In some examples, the control valve is an electromechanically operated solenoid valve.

Referring generally to FIGS. 1A, 1B, 1C, and 1D and particularly to, e.g., FIGS. 10 and 11, second brush motor 138 comprises second brush-motor housing 140 and second brush-motor output shaft 142, rotatable relative to second brush-motor housing 140 about fifth axis 148, which is parallel to first axis 110 and third axis 146. Second brush 144 is operatively coupled with second brush-motor output shaft 142 of second brush motor 138. The preceding subject matter of this paragraph characterizes example 10 of the present disclosure, wherein example 10 also includes the subject matter according to example 9, above.

Second brush-motor output shaft 142 of second brush motor 138 transmits rotational motion from second brush motor 138 to second brush 144 such that second brush 144 spins about fourth axis 150.

In some examples, second brush-motor housing 140 is located within second drum opening 312 and is connected to drum 108. In some examples, second brush-motor output shaft 142 of second brush motor 138 extends from drum 108 to be operatively coupled with second brush 144. In various examples, second brush-motor output shaft 142 is rotatable by second brush motor 138 to produce a rotary force or torque when second brush motor 138 is operated. In an example, second brush motor 138 is a rotary pneumatic motor, operatively coupled to and controlled by the pressure source (not shown). A pneumatic motor beneficially facilitates a simple and cost-effective way of spinning second brush 144 about fourth axis 150. In various other examples, second brush motor 138 is any one of various rotational motors, such as an electric motor, a hydraulic motor, or the like.

In some examples, the controller includes and at least one second control valve that is pneumatically coupled to the pressure source and second brush motor 138. The controller is configured to control application of pneumatic pressure from the pressure source to second brush motor 138. In some examples, the second control valve is a two-way valve. In some examples, the second control valve is an electromechanically operated solenoid valve.

Referring generally to FIGS. 1A, 1B, 1C, and 1D and particularly to, e.g., FIGS. 3-5 and 8, brush 112 is connected to brush-motor output shaft 152 and second axis 116 is coincident with third axis 146. The preceding subject matter of this paragraph characterizes example 11 of the present disclosure, wherein example 11 also includes the subject matter according to example 10, above.

Connecting brush 112 to brush-motor output shaft 152 of brush motor 114 positions second axis 116 coincidental with third axis 146 and positions brush 112 inline with brush motor 114.

In some examples, brush 112 is fastened, clamped, or otherwise securely connected directly to brush-motor output shaft 152 of brush motor 114 such that rotation of brush-motor output shaft 152 co-rotates brush 112. In some examples, apparatus 100 also includes union coupling 314 (FIG. 4), operatively coupling brush-motor output shaft 152 of brush motor 114 to brush 112, to facilitate transmission of power from brush motor 114 to brush 112. In some examples, union coupling 314 is a rotary union that is co-rotatably coupled to brush-motor output shaft 152 of brush motor 114, at one end of union coupling 314, and is co-rotatably coupled to brush 112, at opposite end of union coupling 314.

Referring generally to FIGS. 1A, 1B, 1C, and 1D and particularly to, e.g., FIGS. 3-5 and 8, second brush 144 is connected to second brush-motor output shaft 142 and fourth axis 150 is coincident with fifth axis 148. The preceding subject matter of this paragraph characterizes example 12 of the present disclosure, wherein example 12 also includes the subject matter according to example 11, above.

Connecting second brush 144 to second brush-motor output shaft 142 of second brush motor 138 positions fourth axis 150 coincidental with fifth axis 148 and positions second brush 144 inline with second brush motor 138.

In some examples, second brush 144 is fastened, clamped, or otherwise securely connected directly to second brush-motor output shaft 142 of second brush motor 138 such that rotation of second brush-motor output shaft 142 co-rotates second brush 144. In some examples, apparatus 100 also includes second union coupling (not shown), operatively coupling second brush-motor output shaft 142 of second brush motor 138 to second brush 144, to facilitate transmission of power from second brush motor 138 to second brush 144. In some examples, second union coupling is a rotary union that is co-rotatably coupled to second brush-motor output shaft 142 of second brush motor 138, at one end of the second union coupling, and is co-rotatably coupled to second brush 144, at opposite end of second union coupling. In some examples, second union coupling is substantially the same as union coupling 314 (FIG. 5) described herein and associated with brush motor 114 and brush 112.

Referring generally to FIGS. 1A, 1B, 1C, and 1D and particularly to, e.g., FIGS. 5, 6, 8, 9, and 11-17, apparatus 100 further comprises brush arm 154, connected to drum 108 and configured to retain brush 112. Brush arm 154 comprises brush drivetrain 170, operatively coupled with brush-motor output shaft 152 of brush motor 114 and with brush 112 to rotate brush 112 relative to brush arm 154 about second axis 116. The preceding subject matter of this paragraph characterizes example 13 of the present disclosure, wherein example 13 also includes the subject matter according to example 10, above.

Brush arm 154 retains brush 112 and is configured to enable brush 112 to spin about second axis 116. Connecting brush 112 to brush arm 154 and operatively coupling brush 112 to brush-motor output shaft 152 of brush motor 114 via brush drivetrain 170 laterally spaces second axis 116 away from third axis 146 and positions brush 112 laterally outboard with respect to drum 108 (e.g., first axis 110) and brush motor 114 (e.g., third axis 146).

Rotation of drum 108 relative to bracket 104 about first axis 110 controls angular orientation of brush arm 154 and brush 112 relative to bracket 104 and surface 102 during the cleaning operation. In some examples, second axis 116 is laterally spaced away from and is parallel to third axis 146 (e.g., the axis of rotation of brush motor 114) and first axis 110. Configuring second axis 116 to be parallel to third axis 146 facilitates reduced complexity and improved reliability of the operative coupling between brush motor 114 and brush 112 via brush drivetrain 170. Positioning second axis 116 to be laterally spaced away from first axis 110 facilitates the first cleaning path of brush 112. Positioning second axis 116 to be laterally spaced away from third axis 146 laterally spaces brush 112 outward relative to drum 108.

In some examples, brush arm 154 includes brush-arm housing 316 (FIGS. 11-16). In some examples, brush-arm housing 316 at least partially encloses and enables secure retention of brush drivetrain 170. Brush-arm housing 316 also facilitates the protection of brush drivetrain 170 from impacts, for example, during movement of apparatus 100, and contaminants.

In some examples, brush-arm housing 316 is connected to drum 108 with brush drivetrain 170, operatively coupled with brush-motor output shaft 152 of brush motor 114. In some examples, brush-arm housing 316 is fixed relative to drum 108 and the angular orientation of brush arm 154 is selectively adjustable about first axis 110 relative to bracket 104 in response to rotation of drum 108.

Referring generally to FIGS. 1A, 1B, 1C, and 1D and particularly to, e.g., FIGS. 5, 6, 8, 9, 11-17, apparatus 100 further comprises second brush arm 156, connected to drum 108 and configured to retain second brush 144. Second brush arm 156 comprises second brush drivetrain 172, operatively coupled with second brush-motor output shaft 142 of second brush motor 138 and with second brush 144 to rotate second brush 144 relative to second brush arm 156 about fourth axis 150. The preceding subject matter of this paragraph characterizes example 14 of the present disclosure, wherein example 14 also includes the subject matter according to example 13, above.

Second brush arm 156 retains second brush 144 and is configured to enable second brush 144 to spin about fourth axis 150. Connecting second brush 144 to second brush arm 156 and operatively coupling second brush 144 to second brush-motor output shaft 142 of second brush motor 138 via second brush drivetrain 172 laterally spaces fourth axis 150 away from fifth axis 148 and positions second brush 144 laterally outboard with respect to drum 108 and second brush motor 138.

Rotation of drum 108 relative to bracket 104 about first axis 110 controls angular orientation of second brush arm 156 and second brush 144 relative to bracket 104 and surface 102 during the cleaning operation. In some examples, fourth axis 150 is laterally spaced away from and is parallel to fifth axis 148 (e.g., the axis of rotation of second brush motor 138) and first axis 110. Configuring fourth axis 150 to be parallel to fifth axis 148 facilitates reduced complexity and improved reliability of the operative coupling between second brush motor 138 and second brush 144 via second brush drivetrain 172. Positioning fourth axis 150 to be laterally spaced away from first axis 110 facilitates the second cleaning path of second brush 144. Positioning fourth axis 150 to be laterally spaced away from fifth axis 148 laterally spaces second brush 144 outward relative to drum 108.

In some examples, second brush arm 156 includes second brush-arm housing 318 (FIGS. 15 and 16). In some examples, second brush-arm housing 318 at least partially encloses and enables secure retention of second brush drivetrain 172. Second brush-arm housing 318 also facilitates the protection of second brush drivetrain 172 from impacts, for example, during movement of apparatus 100, and contaminants.

In some examples, second brush-arm housing 318 is connected to drum 108 with second brush drivetrain 172, operatively coupled with second brush-motor output shaft 142 of second brush motor 138. In some examples, second brush-arm housing 318 is fixed relative to drum 108 and the angular orientation of second brush arm 156 is selectively adjustable about first axis 110 relative to bracket 104 in response to rotation of drum 108.

Referring generally to FIGS. 1A, 1B, 1C, and 1D and particularly to, e.g., FIGS. 9 and 11, brush drivetrain 170 comprises brush-drive input component 158, connected to brush-motor output shaft 152 of brush motor 114 and rotatable about third axis 146 relative to brush motor 114. Brush drivetrain 170 also comprises brush-drive output component 160, rotatable about second axis 116 relative to brush arm 154. Brush drivetrain 170 additionally comprises brush power-transmitting component 180, operatively coupled with brush-drive input component 158 and brush-drive output component 160. Brush 112 is configured to be coupled to brush-drive output component 160. The preceding subject matter of this paragraph characterizes example 15 of the present disclosure, wherein example 15 also includes the subject matter according to example 14, above.

Brush drivetrain 170 enables brush-motor output shaft 152 of brush motor 114 to transmit rotational motion from brush motor 114 to brush 112 such that brush 112 spins about second axis 116.

In some examples, brush-drive input component 158 is fastened, clamped, or otherwise securely connected directly to brush-motor output shaft 152 of brush motor 114 such that rotation of brush-motor output shaft 152 co-rotates brush-drive input component 158. In some examples, brush-drive output component 160 is mounted to brush-arm housing 316 and is rotatable relative to brush-arm housing 316 about second axis 116.

Brush motor 114 being operatively coupled with brush-drive input component 158 and brush-drive input component 158 being operatively coupled with brush-drive output component 160, via brush power-transmitting component 180, enables brush motor 114 to selectively rotate brush-drive output component 160 and brush 112, which is operatively coupled to brush-drive output component 160. In other words, brush-drive input component 158 and brush power-transmitting component 180 facilitate transmission of power from brush motor 114 to brush-drive output component 160, which rotates brush 112.

In an example, each of brush-drive input component 158 and brush-drive output component 160 includes (or is) a gear or a sprocket. In an example, brush power-transmitting component 180 includes (or is) a gear train. A gear train provides an efficient and reliable mechanism to transmit power from brush-drive input component 158 to brush-drive output component 160, such as when brush-drive output component 160 is not coincidental with third axis 146. Alternatively, in some other examples, brush power-transmitting component 180 includes (or is) a belt or a chain.

In some examples, brush-arm housing 316 includes bearings that facilitate low-friction rotation of brush-drive input component 158, brush-drive output component 160, and, optionally, brush power-transmitting component 180, for example, when brush power-transmitting component 180 is a gear train. In some examples, bearings are any one of various types of bearings, such as annular bearings, radial ball bearings, or the like.

Referring generally to FIGS. 1A, 1B, 1C, and 1D and particularly to, e.g., FIGS. 13 and 16, brush arm 154 further comprises brush bearing 176. Brush 112 comprises brush body 178, configured to be connected to brush bearing 176. The preceding subject matter of this paragraph characterizes example 16 of the present disclosure, wherein example 16 also includes the subject matter according to example 15, above.

Connection of brush body 178 to brush bearing 176 provides a secure connection between brush 112 and brush arm 154 and facilitates rotation of brush 112 about second axis 116. Connection of brush body 178 to brush bearing 176 also enables brush 112 to be quickly and easily retained by brush arm 154, such that brush 112 is operatively coupled with brush-drive output component 160, and also removed from brush arm 154.

In an example, brush bearing 176 is an annular bearing and includes an inner race that is connected to an annular flange of brush-arm housing 316 and an outer race that is connected to the inner race and that is rotatable relative to the inner race about second axis 116. In an example, brush body 178 includes engagement portion 320 (FIGS. 13 and 16) that is configured to be connected to the outer race of brush bearing 176. In an example, engagement portion 320 includes an annular clip that is configured to form an interference fit or snap fit connection with brush bearing 176.

In an example, brush-arm housing 316 includes, or defines, a brush receptacle, configured to receive brush body 178 of brush 112 and to enable engagement portion 320 of brush body 178 to access and be connected to brush bearing 176. The brush receptacle enables brush 112 to be quickly and easily retained by brush arm 154 and to be operatively coupled with brush-drive output component 160. In an example, with brush body 178 of brush 112 connected to brush bearing 176, at least a portion of brush body 178 engages brush-drive output component 160 such that rotation of brush-drive output component 160 relative to brush-arm housing 316 about second axis 116 co-rotates brush 112 relative to brush-arm housing 316 about second axis 116. In an example, brush body 178 and brush-drive output component 160 define a keyed joint. In an example, brush body 178 includes a hex socket and brush-drive output component 160 includes a hex head, configured to fit within an opening of the hex socket of brush body 178.

In some examples, the interference fit between brush body 178 and brush bearing 176 promotes secure retention of brush 112 within the brush receptacle and facilitates co-rotation of brush-drive output component 160 and brush 112. Additionally, the interference fit between brush body 178 and brush bearing 176 enables brush arm 154 to retain brush 112 by simply inserting brush body 178 of brush 112 into the brush receptacle without the need for additional fasteners.

Referring generally to FIGS. 1A, 1B, 1C, and 1D and particularly to, e.g., FIGS. 11, 13, and 16, second brush drivetrain 172 comprises second brush-drive input component 182, connected to second brush-motor output shaft 142 of second brush motor 138 and rotatable about fifth axis 148 relative to second brush motor 138. Second brush drivetrain 172 also comprises second brush-drive output component 184, rotatable about fourth axis 150 relative to second brush arm 156. Second brush drivetrain 172 additionally comprises second brush power-transmitting component 186, operatively coupled with second brush-drive input component 182 and second brush-drive output component 184. Second brush 144 is configured to be coupled to second brush-drive output component 184. The preceding subject matter of this paragraph characterizes example 17 of the present disclosure, wherein example 17 also includes the subject matter according to example 16, above.

Second brush drivetrain 172 enables second brush-motor output shaft 142 of second brush motor 138 to transmit rotational motion from second brush motor 138 to second brush 144 such that second brush 144 spins about fourth axis 150.

In some examples, second brush-drive input component 182 is fastened, clamped, or otherwise securely connected directly to second brush-motor output shaft 142 of second brush motor 138 such that rotation of second brush-motor output shaft 142 co-rotates second brush-drive input component 182. In some examples, second brush-drive output component 184 is mounted to second brush-arm housing 318 and is rotatable relative to second brush-arm housing 318 about fourth axis 150.

Second brush motor 138 being operatively coupled with second brush-drive input component 182 and second brush-drive input component 182 being operatively coupled with second brush-drive output component 184, via second brush power-transmitting component 186, enables second brush motor 138 to selectively rotate second brush-drive output component 184 and second brush 144, which is operatively coupled to second brush-drive output component 184. In other words, second brush-drive input component 182 and second brush power-transmitting component 186 facilitate transmission of power from second brush motor 138 to second brush-drive output component 184, which rotates second brush 144.

In an example, each of second brush-drive input component 182 and second brush-drive output component 184 includes (or is) a gear or a sprocket. In an example, second brush power-transmitting component 186 includes (or is) a gear train. A gear train provides an efficient and reliable mechanism to transmit power from second brush-drive input component 182 to second brush-drive output component 184, such as when second brush-drive output component 184 is not coincidental with fifth axis 148. Alternatively, in some other examples, second brush power-transmitting component 186 includes (or is) a belt or a chain.

In some examples, second brush-arm housing 318 includes bearings that facilitate low-friction rotation of second brush-drive input component 182, second brush-drive output component 184, and, optionally, second brush power-transmitting component 186, for example, when second brush power-transmitting component 186 is a gear train. In some examples, bearings are any one of various types of bearings, such as annular bearings, radial ball bearings, or the like.

Referring generally to FIGS. 1A, 1B, 1C, and 1D and particularly to, e.g., FIGS. 13 and 16, second brush arm 156 further comprises second brush bearing 190. Second brush 144 comprises second brush body 188, configured to be connected to second brush bearing 190. The preceding subject matter of this paragraph characterizes example 18 of the present disclosure, wherein example 18 also includes the subject matter according to example 17, above.

Connection of second brush body 188 to second brush bearing 190 provides a secure connection between second brush 144 and second brush arm 156 and facilitates rotation of second brush 144 about fourth axis 150. Connection of second brush body 188 to second brush bearing 190 also enables second brush 144 to be quickly and easily retained by second brush arm 156, such that second brush 144 is operatively coupled with second brush-drive output component 184, and removed from second brush arm 156.

In an example, second brush bearing 190 is an annular bearing and includes an inner race that is connected to an annular flange of second brush-arm housing 318 and an outer race that is connected to the inner race and that is rotatable relative to the inner race about fourth axis 150. In an example, second brush body 188 includes second engagement portion 322 (FIG. 14) that is configured to be connected to the outer race of second brush bearing 190. In an example, second engagement portion 322 includes an annular clip that is configured to form an interference fit or snap fit connection with second brush bearing 190.

In an example, second brush-arm housing 318 includes, or defines, a second brush receptacle, configured to receive second brush body 188 of second brush 144 and to enable second engagement portion 322 of second brush body 188 to access and be connected to second brush bearing 190. The second brush receptacle enables second brush 144 to be quickly and easily retained by second brush arm 156 and to be operatively coupled with second brush-drive output component 184. In an example, with second brush body 188 of second brush 144 connected to second brush bearing 190, at least a portion of second brush body 188 engages second brush-drive output component 184 such that rotation of second brush-drive output component 184 relative to second brush-arm housing 318 about fourth axis 150 co-rotates second brush 144 relative to second brush-arm housing 318 about fourth axis 150. In an example, second brush body 188 and second brush-drive output component 184 define a keyed joint. In an example, second brush body 188 includes a hex socket and second brush-drive output component 184 includes a hex head, configured to fit within an opening of the hex socket of second brush body 188.

In some examples, the interference fit between second brush body 188 and second brush bearing 190 promotes secure retention of second brush 144 within the brush receptacle and facilitates co-rotation of second brush-drive output component 184 and second brush 144. Additionally, the interference fit between second brush body 188 and second brush bearing 190 enables second brush arm 156 to retain second brush 144 by simply inserting second brush body 188 of second brush 144 into the brush receptacle without the need for additional fasteners.

Referring generally to FIGS. 1A, 1B, 1C, and 1D and particularly to, e.g., FIGS. 14 and 15, apparatus 100 further comprises brush-arm motor 192, mounted to drum 108. Brush arm 154 is rotatable by brush-arm motor 192 relative to drum 108 about sixth axis 208, which is coincident with third axis 146. The preceding subject matter of this paragraph characterizes example 19 of the present disclosure, wherein example 19 also includes the subject matter according to example 18, above.

With brush 112 positioned in contact with surface 102, rotation of brush arm 154 relative to drum 108 about sixth axis 208 orbitally revolves brush 112 about sixth axis 208 relative to surface 102 and provides a fifth cleaning action to surface 102 (e.g., brush 112 orbits sixth axis 208 on surface 102).

Drum 108 provides a supporting structure for mounting brush-arm motor 192 and brush arm 154. In some examples, drum 108 includes third drum opening 324 (FIG. 12) and brush-arm motor 192 is at least partially located within third drum opening 324. Brush-arm motor 192 transmits rotational motion to brush arm 154 such that brush arm 154 revolves relative to drum 108 about sixth axis 208 and brush 112 orbitally revolves about sixth axis 208. In an example, brush arm 154 is fully rotatable (e.g., is capable of 360-degree rotation). In an example, brush arm 154 is partially rotatable (e.g., is capable of less than 360-degree rotation). In some examples, brush arm 154 spins about sixth axis 208 in a first rotational direction (e.g., clockwise). In some examples, brush arm 154 oscillates between full or partial rotation about sixth axis 208 in the first rotational direction and a second rotational direction, opposite the first rotational direction (e.g., counter clockwise). In some examples, the fifth cleaning action of brush 112 is circular or semi-circular, for example, depending upon the rotation of brush arm 154.

Referring generally to FIGS. 1A, 1B, 1C, and 1D and particularly to, e.g., FIGS. 14 and 15, second brush arm 156 is rotatable by brush-arm motor 192 relative to drum 108 about seventh axis 214, which is coincident with fifth axis 148. The preceding subject matter of this paragraph characterizes example 20 of the present disclosure, wherein example 20 also includes the subject matter according to example 19, above.

With second brush 144 positioned in contact with surface 102, rotation of second brush arm 156 relative to drum 108 about seventh axis 214 orbitally revolves second brush 144 about seventh axis 214 relative to surface 102 and provides a sixth cleaning action to surface 102 (e.g., second brush 144 orbits seventh axis 214 on surface 102).

Brush-arm motor 192 transmits rotational motion to second brush arm 156 such that second brush arm 156 revolves relative to drum 108 about seventh axis 214 and second brush 144 orbitally revolves about seventh axis 214. In an example, second brush arm 156 is partially rotatable (e.g., is capable of less than 360-degree rotation). In some examples, second brush arm 156 oscillates between full or partial rotation about seventh axis 214 in the first rotational direction and a rotational second direction, opposite the first rotational direction (e.g., counter clockwise). In some examples, the sixth cleaning action of second brush 144 is semi-circular, for example, depending upon the rotation of second brush arm 156. In some examples, rotation of brush arm 154 and second brush arm 156 is coordinated. In an example, both brush arm 154 and second brush arm 156 rotate together in the same direction. In an example, brush arm 154 and second brush arm 156 rotate in opposite directions.

Referring generally to FIGS. 1A, 1B, 1C, and 1D and particularly to, e.g., FIG. 12, brush-arm motor 192 comprises brush-arm-motor housing 210 and brush-arm-motor output shaft 212, rotatable relative to brush-arm-motor housing 210 about eighth axis 216, which is parallel to first axis 110. Brush arm 154 is operatively coupled with brush-arm-motor output shaft 212. The preceding subject matter of this paragraph characterizes example 21 of the present disclosure, wherein example 21 also includes the subject matter according to example 20, above.

Brush-arm-motor output shaft 212 of brush-arm motor 192 transmits rotational motion from brush-arm motor 192 to brush arm 154 such that brush 112 spins about second axis 116 and revolves about sixth axis 208.

In some examples, brush-arm-motor housing 210 is located within third drum opening 324 and is connected to drum 108. In some examples, brush-arm-motor output shaft 212 of brush-arm motor 192 extends from drum 108 to be operatively coupled with brush arm 154. In various examples, brush-arm-motor output shaft 212 is rotatable by brush-arm motor 192 to produce a rotary force or torque when brush-arm motor 192 is operated. In various examples, brush-arm motor 192 is any one of various rotational motors, such as an electric motor, a hydraulic motor, a pneumatic motor, or the like.

In an example, brush-arm motor 192 is a stepper motor that divides a full rotation into a number of equal steps. The rotational orientation of brush-arm-motor output shaft 212 can be controlled or commanded, for example, by the controller, to move and hold at one of the steps without any position sensor for feedback. Commanded rotation of brush-arm motor 192 enables selective rotation of brush arm 154 relative to drum 108 about sixth axis 208.

Referring generally to FIGS. 1A, 1B, 1C, and 1D and particularly to, e.g., FIGS. 11, 13, and 15, apparatus 100 further comprises brush-arm drivetrain 194, operatively coupled with brush-arm-motor output shaft 212 of brush-arm motor 192 and with brush arm 154 to rotate brush arm 154 relative to drum 108 about sixth axis 208. The preceding subject matter of this paragraph characterizes example 22 of the present disclosure, wherein example 22 also includes the subject matter according to example 21, above.

Operatively coupling brush arm 154 to brush-arm-motor output shaft 212 of brush-arm motor 192 via brush-arm drivetrain 194 spaces sixth axis 208 laterally away from eighth axis 216 and positions brush arm 154 laterally outboard with respect to drum 108 (e.g., first axis 110) and brush-arm motor 192 (e.g., eighth axis 216).

Rotation of brush arm 154 relative to drum 108 about sixth axis 208 controls angular orientation of brush arm 154 and brush 112 relative to drum 108 and surface 102 during the cleaning operation.

Referring generally to FIGS. 1A, 1B, 1C, and 1D and particularly to, e.g., FIGS. 11, 13, and 15, brush-arm drivetrain 194 is operatively coupled with second brush arm 156 to rotate second brush arm 156 relative to drum 108 about seventh axis 214. The preceding subject matter of this paragraph characterizes example 23 of the present disclosure, wherein example 23 also includes the subject matter according to example 22, above.

Operatively coupling second brush arm 156 to brush-arm-motor output shaft 212 of brush-arm motor 192 via brush-arm drivetrain 194 spaces seventh axis 214 laterally away from eighth axis 216 and positions second brush arm 156 laterally outboard with respect to drum 108 (e.g., first axis 110) and brush-arm motor 192 (e.g., eighth axis 216).

Rotation of second brush arm 156 relative to drum 108 about seventh axis 214 controls angular orientation of second brush arm 156 and second brush 144 relative to drum 108 and surface 102 during the cleaning operation.

Referring generally to FIGS. 1A, 1B, 1C, and 1D and particularly to, e.g., FIGS. 13 and 15, brush-arm drivetrain 194 comprises brush-arm-drive input component 200, connected to brush-arm-motor output shaft 212 of brush-arm motor 192 and rotatable about eighth axis 216 relative to brush-arm motor 192. Brush-arm drivetrain 194 also comprises brush-arm-drive output component 202, rotatable about sixth axis 208 relative to drum 108. Brush-arm drivetrain 194 additionally comprises brush-arm power-transmitting component 204, operatively coupled with brush-arm-drive input component 200 and with brush-arm-drive output component 202. Brush arm 154 is connected to brush-arm-drive output component 202. The preceding subject matter of this paragraph characterizes example 24 of the present disclosure, wherein example 24 also includes the subject matter according to example 23, above.

Brush-arm drivetrain 194 enables brush-arm-motor output shaft 212 of brush-arm motor 192 to transmit rotational motion from brush-arm motor 192 to brush arm 154 such that brush arm 154 rotates about sixth axis 208 and brush 112 orbitally revolves about sixth axis 208.

In some examples, brush-arm-drive input component 200 is fastened, clamped, or otherwise securely connected directly to brush-arm-motor output shaft 212 of brush-arm motor 192 such that rotation of brush-arm-motor output shaft 212 co-rotates brush-arm-drive input component 200. In some examples, brush-arm-drive output component 202 is mounted to brush-arm housing 316. Brush-arm motor 192 being operatively coupled with brush-arm-drive input component 200 and brush-arm-drive input component 200 being operatively coupled with brush-arm-drive output component 202, via brush-arm power-transmitting component 204, enables brush-arm motor 192 to selectively rotate brush-arm-drive output component 202 and brush arm 154, which is operatively coupled to brush-arm-drive output component 202. In other words, brush-arm-drive input component 200 and brush-arm power-transmitting component 204 facilitate transmission of power from brush-arm motor 192 to brush-arm-drive output component 202, which rotates brush arm 154.

In an example, each of brush-arm-drive input component 200 and brush-arm-drive output component 202 includes (or is) a gear or a sprocket. In an example, brush-arm power-transmitting component 204 includes (or is) a gear train. A gear train provides an efficient and reliable mechanism to transmit power from brush-arm-drive input component 200 to brush-arm-drive output component 202. Alternatively, in some other examples, brush-arm power-transmitting component 204 includes (or is) a belt or a chain.

Referring generally to FIGS. 1A, 1B, 1C, and 1D and particularly to, e.g., FIGS. 13 and 15, brush-arm drivetrain 194 further comprises second brush-arm-drive output component 206, rotatable about seventh axis 214 relative to drum 108. Brush-arm power-transmitting component 204 is operatively coupled with second brush-arm-drive output component 206. Second brush arm 156 is connected to second brush-arm-drive output component 206. The preceding subject matter of this paragraph characterizes example 25 of the present disclosure, wherein example 25 also includes the subject matter according to example 24, above.

Brush-arm drivetrain 194 enables brush-arm-motor output shaft 212 of brush-arm motor 192 to transmit rotational motion from brush-arm motor 192 to second brush arm 156 such that second brush arm 156 rotates about seventh axis 214 and second brush 144 revolves about seventh axis 214.

In some examples, second brush-arm-drive output component 206 is mounted to second brush-arm housing 318. Brush-arm motor 192 being operatively coupled with brush-arm-drive input component 200 and brush-arm-drive input component 200 being operatively coupled with second brush-arm-drive output component 206, via brush-arm power-transmitting component 204, enables brush-arm motor 192 to selectively rotate second brush-arm-drive output component 206 and second brush arm 156, which is operatively coupled to second brush-arm-drive output component 206. In other words, brush-arm-drive input component 200 and brush-arm power-transmitting component 204 facilitate transmission of power from brush-arm motor 192 to second brush-arm-drive output component 206, which rotates second brush arm 156.

In an example, each of brush-arm-drive input component 200 and second brush-arm-drive output component 206 includes (or is) a gear or a sprocket. In an example, brush-arm power-transmitting component 204 includes (or is) a gear train. A gear train provides an efficient and reliable mechanism to transmit power from brush-arm-drive input component 200 to second brush-arm-drive output component 206. Alternatively, in some other examples, brush-arm power-transmitting component 204 includes (or is) a belt or a chain.

Referring generally to FIGS. 1A, 1B, 1C, and 1D and particularly to, e.g., FIGS. 10 and 11, apparatus 100 further comprises tubular sleeve 218, coupled to drum 108 and rotatable relative to drum 108 about sixth axis 208. Brush motor 114 is positioned within tubular sleeve 218. Brush arm 154 is connected to tubular sleeve 218. Rotation of brush arm 154 by brush-arm motor 192 relative to drum 108 about sixth axis 208 co-rotates tubular sleeve 218 relative to drum 108 about sixth axis 208. The preceding subject matter of this paragraph characterizes example 26 of the present disclosure, wherein example 26 also includes the subject matter according to example 25, above.

Tubular sleeve 218, being rotatably coupled to drum 108, enables brush motor 114 to co-rotate with brush arm 154 relative to drum 108 about sixth axis 208.

Co-rotation of brush motor 114 and brush arm 154 about sixth axis 208 enables brush motor 114 to rotate brush 112 about second axis 116 while brush arm 154 rotates about sixth axis 208. Co-rotation of brush motor 114 and brush arm 154 about sixth axis 208 also facilitates a simplified and reliable way of coordinating rotational movement of brush arm 154 and brush 112. Locating brush motor 114 within tubular sleeve 218 positions third axis 146 (axis of rotation of brush motor 114) coincidental with sixth axis 208 (axis or rotation of brush arm 154 and tubular sleeve 218).

In some examples, tubular sleeve 218 is at least partially located within drum opening 306 and is connected to drum 108. In some examples, drum 108 provides a supporting structure for mounting tubular sleeve 218. Tubular sleeve 218 provides a supporting structure for mounting brush motor 114 to drum 108 and for mounting brush arm 154. In various examples, tubular sleeve 218 is coupled to drum 108 in any manner suitable to enable rotation of tubular sleeve 218 relative to drum 108 about sixth axis 208. In some examples, apparatus 100 also includes one or more second annular bearings 326 (FIG. 8) that are coupled to an exterior of tubular sleeve 218. In an example, a first one of second annular bearings 326 is located at one (e.g., a first) end of tubular sleeve 218 and a second one of second annular bearings 326 is located at the other (e.g., a second) end of tubular sleeve 218.

Referring generally to FIGS. 1A, 1B, 1C, and 1D and particularly to, e.g., FIGS. 10 and 11, apparatus 100 further comprises second tubular sleeve 220, coupled to drum 108 and rotatable relative to drum 108 about seventh axis 214. Second brush motor 138 is positioned within second tubular sleeve 220. Second brush arm 156 is connected to second tubular sleeve 220. Rotation of second brush arm 156 by brush-arm motor 192 relative to drum 108 about seventh axis 214 co-rotates second tubular sleeve 220 relative to drum 108 about seventh axis 214. The preceding subject matter of this paragraph characterizes example 27 of the present disclosure, wherein example 27 also includes the subject matter according to example 26, above.

Second tubular sleeve 220, being rotatably coupled to drum 108, enables second brush motor 138 to co-rotate with second brush arm 156 relative to drum 108 about seventh axis 214.

Co-rotation of second brush motor 138 and second brush arm 156 about seventh axis 214 enables second brush motor 138 to rotate second brush 144 about fourth axis 150 while second brush arm 156 rotates about seventh axis 214. Co-rotation of second brush motor 138 and second brush arm 156 about seventh axis 214 also facilitates a simplified and reliable way of coordinating rotational movement of second brush arm 156 and second brush 144. Locating second brush motor 138 within second tubular sleeve 220 positions fifth axis 148 (axis of rotation of second brush motor 138) coincidental with seventh axis 214 (axis or rotation of second brush arm 156 and second tubular sleeve 220).

In some examples, second tubular sleeve 220 is at least partially located within second drum opening 312 and is connected to drum 108. In some examples, drum 108 provides a supporting structure for mounting second tubular sleeve 220. Tubular sleeve 218 provides a supporting structure for mounting brush motor 114 to drum 108 and for mounting second brush arm 156. In various examples, second tubular sleeve 220 is coupled to drum 108 in any manner suitable to enable rotation of second tubular sleeve 220 relative to drum 108 about seventh axis 214. In some examples, apparatus 100 also includes one or more third annular bearings 328 (FIG. 8) that are coupled to an exterior of second tubular sleeve 220. In an example, a first one of third annular bearings 328 is located at one (e.g., a first) end of second tubular sleeve 220 and a second one of third annular bearings 328 is located at the other (e.g., a second) end of second tubular sleeve 220.

Referring generally to FIGS. 1A, 1B, 1C, and 1D and particularly to, e.g., FIGS. 12-17, apparatus 100 further comprises central suction-delivery tube 122, configured to deliver suction to a center of brush 112, and peripheral suction-delivery tube 222, configured to deliver suction to a periphery of brush 112. The preceding subject matter of this paragraph characterizes example 28 of the present disclosure, wherein example 28 also includes the subject matter according to any one of examples 3 to 27, above.

Central suction-delivery tube 122 and peripheral suction-delivery tube 222 enable suction to be delivered from a vacuum source (not shown) to brush 112.

Suction being delivered to brush 112 facilitates the capture, collection, and disposal of contaminants removed from surface 102 by brush 112 during the cleaning operation. Suction also facilitates the capture, collection, and disposal of cleaning fluid utilized during the cleaning operation and/or fumes, generated by the cleaning fluid or the contaminants. In an example, central suction-delivery tube 122 is located relative to brush 112 to deliver a first (e.g., a central) portion of suction to the center of brush 112. In an example, peripheral suction-delivery tube 222 is located relative to brush 112 to deliver a second (e.g., peripheral) portion of suction to the periphery of brush 112. In some examples, the first portion of suction, which is directed at the center of brush 112, is particularly beneficial for capturing fumes emanating from surface 102. In some examples, the second portion of suction, which is directed at the periphery of brush 112, is particularly beneficial for capturing contaminants and/or cleaning fluid that is removed from surface 102 by the cleaning actions of brush 112, for example, due to the centrifugal force of brush 112 directing contaminants and/or cleaning fluid away from second axis 116 (axis of rotation of brush 112).

In some examples, central suction-delivery tube 122 and peripheral suction-delivery tube 222 are flexible. Sufficient flexibility of central suction-delivery tube 122 and peripheral suction-delivery tube 222 enables rotational movement of drum 108 and/or brush arm 154. While the illustrative examples show apparatus 100 including one central suction-delivery tube 122 and one peripheral suction-delivery tube 222, in other examples, apparatus 100 includes more than one central suction-delivery tube 122 and more than one peripheral suction-delivery tube 222.

In some examples, the vacuum source is operatively coupled to central suction-delivery tube 122 and peripheral suction-delivery tube 222. In some examples, the vacuum source is located at a remote location. In an example, the controller is operatively coupled to the vacuum source to control application of suction.

Referring generally to FIGS. 1A, 1B, 1C, and 1D and particularly to, e.g., FIGS. 12-17, apparatus 100 further comprises fluid-delivery tube 120, configured to deliver cleaning fluid to brush 112. The preceding subject matter of this paragraph characterizes example 29 of the present disclosure, wherein example 29 also includes the subject matter according to example 28, above.

Fluid-delivery tube 120 enables cleaning fluid to be delivered from a cleaning-fluid source (not shown) to brush 112.

Cleaning fluid being delivered to brush 112 facilitates effective removal of contaminants from surface 102 during the cleaning operation. In an example, fluid-delivery tube 120 is located relative to brush 112 to deliver cleaning fluid at an interface of brush 112 and surface. In some examples, cleaning fluid is delivered to bristles 232 of brush 112. In some examples, cleaning fluid is delivered to surface 102.

In some examples, fluid-delivery tube 120 is flexible. Sufficient flexibility of fluid-delivery tube 120 enables rotational movement of drum 108 and/or brush arm 154. In various examples, apparatus 100 includes more than one fluid-delivery tube 120 depending, for example, on a volume of cleaning fluid, a flow rate of cleaning fluid, and the locations relative to brush 112 for delivery of cleaning fluid.

In some examples, the cleaning-fluid source is located at a remote location. In an example, the controller is operatively coupled to the cleaning-fluid source to control application of cleaning fluid.

Referring generally to FIGS. 1A, 1B, 1C, and 1D and particularly to, e.g., FIGS. 12-17, apparatus 100 further comprises brush cover 224, at least partially surrounding brush 112. Brush cover 224 comprises manifold 226, configured to distribute suction and cleaning fluid to brush 112. Central suction-delivery tube 122, peripheral suction-delivery tube 222, and fluid-delivery tube 120 are connected to brush cover 224 and are communicatively coupled with manifold 226. The preceding subject matter of this paragraph characterizes example 30 of the present disclosure, wherein example 30 also includes the subject matter according to example 29, above.

Brush cover 224 provides an enclosure that at least partially surrounds brush 112. Central suction-delivery tube 122, peripheral suction-delivery tube 222, and fluid-delivery tube 120 are connected to brush cover 224. Manifold 226 enables distribution of suction and cleaning fluid to different locations relative to brush 112.

In an example, brush cover 224 is connected to brush-arm housing 316. In some examples, brush cover 224 at least partially circumscribes brush 112 and second axis 116. In an example, brush cover 224 includes a cover body that is connected to brush-arm housing 316 and that least partially circumscribes brush 112. In an example, brush cover 224 also includes a cover cap that is connected to a top of brush-arm housing 316 and that is axially aligned with brush 112.

In some examples, manifold 226 includes a plurality of inlet ports, exterior to brush cover 224, a plurality of outlet ports, interior to brush cover 224 and positioned relative to brush 112, and a plurality of delivery channels, formed through brush cover 224, each one of the delivery channels extends from an associated one of the inlet ports to an associated one of the outlet ports. Each one of central suction-delivery tube 122, peripheral suction-delivery tube 222, and fluid-delivery tube 120 is communicatively coupled with one of the inlet ports of an associated delivery channel.

In an example, central suction-delivery tube 122 is connected to a central suction-delivery inlet port and is in fluid communication with a central suction-delivery channel of manifold 226 to deliver suction from central suction-delivery tube 122 to the central suction-delivery outlet port. In an example, the central suction-delivery channel of manifold 226 at least partially extends through the cover cap of brush cover 224. The central suction-delivery outlet port applies suction to brush 112. In some examples, the central suction-delivery outlet port is located at any one of various locations on the interior of brush cover 224 and relative to the center of brush 112. In some examples, brush body 178 has a central brush-body opening communicatively coupled with central suction-delivery outlet port to apply suction to the center of brush 112. In some examples, manifold 226 is configured such that a single central suction-delivery inlet port feeds a plurality of central suction-delivery outlet ports. In some examples, manifold 226 is configured such that a plurality of central suction-delivery inlet ports, each communicatively coupled with one associated central suction-delivery tube 122, feed the plurality of central suction-delivery outlet ports. In an example, at least one central suction-delivery outlet port is located through brush 112, for example, proximate to the center of brush 112.

In an example, peripheral suction-delivery tube 222 is connected to a peripheral suction-delivery inlet port and is in fluid communication with a peripheral suction-delivery channel of manifold 226 to deliver suction from peripheral suction-delivery tube 222 to the peripheral suction-delivery outlet port. In an example, the peripheral suction-delivery channel of manifold 226 at least partially extends through the cover body of brush cover 224. The peripheral suction-delivery outlet port applies suction to brush 112. In some examples, the peripheral suction-delivery outlet port is located at any one of various locations on the interior of brush cover 224 (e.g., along the cover body) and relative to the periphery of brush 112. In some examples, manifold 226 is configured such that a single peripheral suction-delivery inlet port feeds a plurality of peripheral suction-delivery outlet ports. In some examples, manifold 226 is configured such that a plurality of peripheral suction-delivery inlet ports, each communicatively coupled with one associated peripheral suction-delivery tube 222, feed the plurality of peripheral suction-delivery outlet ports. In an example, the peripheral suction-delivery outlet ports are distributed around a perimeter of the interior of brush cover 224, for example, around the periphery of brush 112.

In an example, fluid-delivery tube 120 is connected to a fluid-delivery inlet port and is in fluid communication with a fluid-delivery channel of manifold 226 to transfer cleaning fluid from fluid-delivery tube 120 to the fluid-delivery outlet port. In an example, the fluid-delivery channel of manifold 226 at least partially extends through the cover body of brush cover 224. The fluid-delivery outlet port dispenses cleaning fluid to brush 112. In some examples, the fluid-delivery outlet port is located at any one of various locations on the interior of brush cover 224 (e.g., along the cover body) and relative to brush 112. In some examples, manifold 226 is configured such that a single fluid-delivery inlet port feeds a plurality of fluid-delivery outlet ports. In some examples, manifold 226 is configured such that a plurality of fluid-delivery inlet ports, each communicatively coupled with one associated fluid-delivery tube 120, feed the plurality of fluid-delivery outlet ports. In an example, the fluid-delivery outlet ports are distributed around a perimeter of the interior of brush cover 224, for example, around the periphery of brush 112.

Referring generally to FIGS. 1A, 1B, 1C, and 1D and particularly to, e.g., FIGS. 13 and 16, apparatus 100 further comprises extension tube 230, connected to brush cover 224 and brush 112. Extension tube 230 extends through the center of brush 112. Extension tube 230 is communicatively coupled with manifold 226 to deliver the suction to the center of brush 112. The preceding subject matter of this paragraph characterizes example 31 of the present disclosure, wherein example 31 also includes the subject matter according to example 30, above.

Extension tube 230 forms an extension of manifold 226 and extends application of suction through brush 112 such that suction is applied proximate to (e.g., at or near) surface 102 when brush 112 is positioned in contact with surface 102.

In an example, extension tube 230 is connected to brush cover 224 and is communicatively coupled with the central suction-delivery channel of manifold 226. In some examples, extension tube 230 extends through the central brush-body opening of brush body 178 to locate the central suction-delivery outlet port closer to surface 102 when brush 112 is placed in contact with surface 102 during the cleaning operation.

Referring generally to FIGS. 1A, 1B, 1C, and 1D and particularly to, e.g., FIGS. 12 and 13, brush 112 comprises bristles 232. Brush cover 224 further comprises cut-out 228, configured to expose a portion of bristles 232. The preceding subject matter of this paragraph characterizes example 32 of the present disclosure, wherein example 32 also includes the subject matter according to example 30 or 31, above.

Cut-out 228 enables bristles 232 to access one or more portions of surface 102 that is not perpendicular to second axis 116.

In some examples, bristles 232 of brush 112 are any one of various types of bristles depending, for example, on the particular type of cleaning being performed by brush 112 and/or the type of contaminants being removed from surface 102 during the cleaning operation.

In an example, cut-out 228 extends from an edge of a lower end of the cover body of brush cover 224, for example, proximate to a bottom of brush 112, and extends toward an upper end of the cover body of brush cover 224. In some examples, the size and/or shape of cut-out 228 varies depending, for example, on the type of brush 112, the type of bristles 232, the type of surface 102 being cleaned, the type of cleaning operation being performed, or the like. In some examples, brush cover 224 includes another cut-out 228 (not visible in FIGS. 10 and 13) that is aligned with cut-out 228 along an axis that is perpendicular to second axis 116. In an example, during the cleaning operation, cut-out 228 enables bristles 232, for example, a portion of bristles 232 projecting from brush body 178, which are oblique and/or perpendicular to second axis 116, to access one or more portions of surface 102 that are not flat. In an example, during the cleaning operation, cut-outs 228 that are aligned enable a protruding portion of surface 102 to fit within those ones of cut-outs 228 for contact with bristles 232.

Referring generally to FIGS. 1A, 1B, 1C, and 1D and particularly to, e.g., FIGS. 12-17, apparatus 100 further comprises second central suction-delivery tube 234, configured to deliver suction to a second center of second brush 144, and second peripheral suction-delivery tube 236, configured to deliver suction to a second periphery of second brush 144. The preceding subject matter of this paragraph characterizes example 33 of the present disclosure, wherein example 33 also includes the subject matter according to example 32, above.

Second central suction-delivery tube 234 and second peripheral suction-delivery tube 236 enable suction to be delivered from the vacuum source to second brush 144.

Suction being delivered to second brush 144 facilitates the capture, collection, and disposal of contaminants removed from surface 102 by second brush 144 during the cleaning operation. Suction also facilitates the capture, collection, and disposal of cleaning fluid utilized during the cleaning operation and/or fumes, generated by the cleaning fluid or the contaminants. In an example, second central suction-delivery tube 234 is located relative to second brush 144 to deliver a first (e.g., a central) portion of suction to the center of second brush 144. In an example, second peripheral suction-delivery tube 236 is located relative to second brush 144 to deliver a second (e.g., peripheral) portion of suction to the periphery of second brush 144. In some examples, the first portion of suction, which is directed at the center of second brush 144, is particularly beneficial for capturing fumes emanating from surface 102. In some examples, the second portion of suction, which is directed at the periphery of second brush 144, is particularly beneficial for capturing contaminants and/or cleaning fluid that is removed from surface 102 by the cleaning actions of second brush 144, for example, due to the centrifugal force of second brush 144 directing contaminants and/or cleaning fluid away from fourth axis 150 (axis of rotation of second brush 144).

In some examples, second central suction-delivery tube 234 and second peripheral suction-delivery tube 236 are flexible. Sufficient flexibility of second central suction-delivery tube 234 and second peripheral suction-delivery tube 236 enables rotational movement of drum 108 and/or second brush arm 156. While the illustrative examples show apparatus 100 including one second central suction-delivery tube 234 and one second peripheral suction-delivery tube 236, in other examples, apparatus 100 includes more than one second central suction-delivery tube 234 and more than one second peripheral suction-delivery tube 236.

In some examples, the vacuum source is operatively coupled to second central suction-delivery tube 234 and second peripheral suction-delivery tube 236. In some examples, the vacuum source is located at a remote location. In an example, the controller is operatively coupled to the vacuum source to control application of suction.

Referring generally to FIGS. 1A, 1B, 1C, and 1D and particularly to, e.g., FIGS. 12-17, apparatus 100 further comprises second fluid-delivery tube 238, configured to deliver cleaning fluid to second brush 144. The preceding subject matter of this paragraph characterizes example 34 of the present disclosure, wherein example 34 also includes the subject matter according to example 33, above.

Second fluid-delivery tube 238 enables cleaning fluid to be delivered from the cleaning-fluid source to second brush 144.

Cleaning fluid being delivered to second brush 144 facilitates effective removal of contaminants from surface 102 during the cleaning operation. In an example, second fluid-delivery tube 238 is located relative to brush 112 to deliver cleaning fluid at an interface of second brush 144 and surface. In some examples, cleaning fluid is delivered to second bristles 246 of second brush 144. In some examples, cleaning fluid is delivered to surface 102.

In some examples, second fluid-delivery tube 238 is flexible. Sufficient flexibility of second fluid-delivery tube 238 enables rotational movement of drum 108 and/or second brush arm 156. In various examples, apparatus 100 includes more than one second fluid-delivery tube 238 depending, for example, on a volume of cleaning fluid, a flow rate of cleaning fluid, and the locations relative to brush 112 for delivery of cleaning fluid.

In some examples, the cleaning-fluid source is located at a remote location. In an example, the controller is operatively coupled to the cleaning-fluid source to control application of cleaning fluid.

Referring generally to FIGS. 1A, 1B, 1C, and 1D and particularly to, e.g., FIGS. 12-17, apparatus 100 further comprises second brush cover 240, at least partially surrounding second brush 144. Second brush cover 240 comprises second manifold 242, configured to distribute the suction and the cleaning fluid to second brush 144. Second central suction-delivery tube 234, second peripheral suction-delivery tube 236, and second fluid-delivery tube 238 are connected to second brush cover 240 and are communicatively coupled with second manifold 242. The preceding subject matter of this paragraph characterizes example 35 of the present disclosure, wherein example 35 also includes the subject matter according to example 34, above.

Second brush cover 240 provides an enclosure, at least partially surrounding second brush 144. Second central suction-delivery tube 234, second peripheral suction-delivery tube 236, and second fluid-delivery tube 238 are connected to second brush cover 240. Second manifold 242 enables distribution of suction and cleaning fluid to different locations relative to second brush 144.

In an example, second brush cover 240 is connected to second brush-arm housing 318 of second brush arm 156. In some examples, second brush cover 240 at least partially circumscribes second brush 144 and fourth axis 150. In an example, second brush cover 240 includes a second cover body that is connected to second brush-arm housing 318 and that least partially circumscribes second brush 144. In an example, second brush cover 240 also includes a second cover cap that is connected to a top of second brush-arm housing 318 and that is axially aligned with second brush 144.

In some examples, second manifold 242 includes a plurality of second inlet ports, exterior to second brush cover 240, a plurality of second outlet ports, interior to second brush cover 240 and positioned relative to second brush 144, and a plurality of second delivery channels, formed through second brush cover 240, each one of the second delivery channels extends from an associated one of the second inlet ports to an associated one of the second outlet ports. Each one of second central suction-delivery tube 234, second peripheral suction-delivery tube 236, and second fluid-delivery tube 238 is communicatively coupled with one of the second inlet ports of the second delivery channel, associated therewith.

In an example, second central suction-delivery tube 234 is connected to a second central suction-delivery inlet port and is in fluid communication with a second central suction-delivery channel of second manifold 242 to deliver suction from second central suction-delivery tube 234 to the second central suction-delivery outlet port. In an example, the second central suction-delivery channel of second manifold 242 at least partially extends through the second cover cap of second brush cover 240. The second central suction-delivery outlet port applies suction to second brush 144. In some examples, the second central suction-delivery outlet port is located at any one of various locations on the interior of second brush cover 240 and relative to the center of second brush 144. In some examples, second brush body 188 has a second central brush-body opening communicatively coupled with the second central suction-delivery outlet port to apply suction to the center of second brush 144. In some examples, second manifold 242 is configured such that a single second central suction-delivery inlet port feeds a plurality of second central suction-delivery outlet ports. In some examples, second manifold 242 is configured such that a plurality of second central suction-delivery inlet ports, each communicatively coupled with one second central suction-delivery tube 234, associated therewith, feed the plurality of second central suction-delivery outlet ports. In an example, at least one second central suction-delivery outlet port is located through second brush 144, for example, proximate to the center of second brush 144.

In an example, second peripheral suction-delivery tube 236 is connected to a second peripheral suction-delivery inlet port and is in fluid communication with a second peripheral suction-delivery channel of second manifold 242 to deliver suction from second peripheral suction-delivery tube 236 to the second peripheral suction-delivery outlet port. In an example, the second peripheral suction-delivery channel of second manifold 242 at least partially extends through the second cover body of second brush cover 240. The second peripheral suction-delivery outlet port applies suction to second brush 144. In some examples, the second peripheral suction-delivery outlet port is located at any one of various locations on the interior of second brush cover 240 (e.g., along the second cover body) and relative to the periphery of second brush 144. In some examples, second manifold 242 is configured such that a single second peripheral suction-delivery inlet port feeds a plurality of second peripheral suction-delivery outlet ports. In some examples, second manifold 242 is configured such that a plurality of second peripheral suction-delivery inlet ports, each communicatively coupled with one second peripheral suction-delivery tube 236, associated therewith, feed the plurality of second peripheral suction-delivery outlet ports. In an example, the second peripheral suction-delivery outlet ports are distributed around a perimeter of the interior of second brush cover 240, for example, around the periphery of second brush 144.

In an example, second fluid-delivery tube 238 is connected to a second fluid-delivery inlet port and is in fluid communication with a second fluid-delivery channel of second manifold 242 to transfer cleaning fluid from second fluid-delivery tube 238 to the fluid-delivery outlet port. In an example, the second fluid-delivery channel of second manifold 242 at least partially extends through the second cover body of second brush cover 240. The second fluid-delivery outlet port dispenses cleaning fluid to second brush 144. In some examples, the second fluid-delivery outlet port is located at any one of various locations on the interior of second brush cover 240 (e.g., along the second cover body) and relative to second brush 144. In some examples, second manifold 242 is configured such that a single second fluid-delivery inlet port feeds a plurality of second fluid-delivery outlet ports. In some examples, second manifold 242 is configured such that a plurality of second fluid-delivery inlet ports, each communicatively coupled with one second fluid-delivery tube 238, associated therewith, feed the plurality of second fluid-delivery outlet ports. In an example, the second fluid-delivery outlet ports are distributed around a perimeter of the interior of second brush cover 240, for example, around the periphery of second brush 144.

Referring generally to FIGS. 1A, 1B, 1C, and 1D and particularly to, e.g., FIGS. 13 and 16, apparatus 100 further comprises second extension tube 244, connected to second brush cover 240 and to second brush 144. Second extension tube 244 extends through second center of second brush 144. Second extension tube 244 is communicatively coupled with second manifold 242 to deliver the suction to the second center of second brush 144. The preceding subject matter of this paragraph characterizes example 36 of the present disclosure, wherein example 36 also includes the subject matter according to example 35, above.

Second extension tube 244 forms an extension of second manifold 242 and extends application of suction through second brush 144 such that suction is applied proximate to surface 102 when second brush 144 is positioned in contact with surface 102.

In an example, second extension tube 244 is connected to second brush cover 240 and is communicatively coupled with the second central suction-delivery channel of second manifold 242. In some examples, second extension tube 244 extends through the second central brush-body opening of second brush body 188 to locate the second central suction-delivery outlet port closer to surface 102 when second brush 144 is placed in contact with surface 102 during the cleaning operation.

Referring generally to FIGS. 1A, 1B, 1C, and 1D and particularly to, e.g., FIGS. 12 and 13, second brush 144 comprises second bristles 246. Second brush cover 240 further comprises second cut-out 248, configured to expose a second portion of second bristles 246. The preceding subject matter of this paragraph characterizes example 37 of the present disclosure, wherein example 37 also includes the subject matter according to example 35 or 36, above.

Second cut-out 248 enables second bristles 246 to access a portion of surface 102 that is not perpendicular to fourth axis 150.

In some examples, second bristles 246 of second brush 144 are any one of various types of bristles depending, for example, on the particular type of cleaning being performed by second brush 144 and/or the type of contaminants being removed from surface 102 during the cleaning operation. In some examples, bristles 232 of brush 112 and second bristles 246 of second brush 144 are the same. In some examples, bristles 232 of brush 112 and second bristles 246 of second brush 144 are different.

In an example, second cut-out 248 extends from an edge of a lower end of the second cover body of second brush cover 240, for example, proximate to a bottom of second brush 144, and extends toward an upper end of the second cover body of second brush cover 240. In some examples, the size and/or shape of second cut-out 248 varies depending, for example, on the type of second brush 144, the type of second bristles 246, the type of surface 102 being cleaned, the type of cleaning operation being performed, or the like. In some examples, second brush cover 240 includes another second cut-out 248 (not visible in FIG. 13) that is aligned with second cut-out 248 along an axis that is perpendicular to fourth axis 150. In an example, during the cleaning operation, second cut-out 248 enables second bristles 246, for example, a portion of second bristles 246 projecting from second brush body 188, which are oblique and/or perpendicular to fourth axis 150, to access one or more portions of surface 102 that are not flat. In an example, during the cleaning operation, second cut-outs 248 that are aligned enable a protruding portion of surface 102 to fit within those ones of second cut-outs 248 for contact with second bristles 246.

Referring generally to FIGS. 1A, 1B, 1C, and 1D and particularly to, e.g., FIGS. 4, 9, and 11, drum 108 further comprises delivery-tube passage 250, extending through drum 108. Central suction-delivery tube 122, peripheral suction-delivery tube 222, and fluid-delivery tube 120 extend through delivery-tube passage 250. The preceding subject matter of this paragraph characterizes example 38 of the present disclosure, wherein example 38 also includes the subject matter according to any one of examples 34 to 37, above.

Delivery-tube passage 250 enables central suction-delivery tube 122, peripheral suction-delivery tube 222, and fluid-delivery tube 120 to pass through drum 108 and exit from a top of drum 108 for connection to a respective vacuum source and cleaning-fluid source, associated therewith. Delivery-tube passage 250 also retains central suction-delivery tube 122, peripheral suction-delivery tube 222, and fluid-delivery tube 120 during rotation of drum 108 about first axis 110.

In an example, delivery-tube passage 250 has a central axis that is parallel to first axis 110. In some examples, central suction-delivery tube 122 extends from brush cover 224, through delivery-tube passage 250, and is connected to a service port of the vacuum source. In some examples, peripheral suction-delivery tube 222 extends from brush cover 224, through delivery-tube passage 250, and is connected to another service port of the vacuum source. In some examples, fluid-delivery tube 120 extends from brush cover 224, through delivery-tube passage 250, and is connected to a service port of the cleaning-fluid source.

Referring generally to FIGS. 1A, 1B, 1C, and 1D and particularly to, e.g., FIGS. 4, 11, and 15, apparatus 100 further comprises delivery tube guide 196, connected to drum 108 and aligned with delivery-tube passage 250. The preceding subject matter of this paragraph characterizes example 39 of the present disclosure, wherein example 39 also includes the subject matter according to example 38, above.

Delivery tube guide 196 protects and guides central suction-delivery tube 122, peripheral suction-delivery tube 222, and fluid-delivery tube 120 into delivery-tube passage 250.

Referring generally to FIGS. 1A, 1B, 1C, and 1D and particularly to, e.g., FIGS. 4, 9, and 11, drum 108 further comprises second delivery-tube passage 252, extending through drum 108. Second central suction-delivery tube 234, second peripheral suction-delivery tube 236, and second fluid-delivery tube 238 extend through second delivery-tube passage 252. The preceding subject matter of this paragraph characterizes example 40 of the present disclosure, wherein example 40 also includes the subject matter according to example 39, above.

Second delivery-tube passage 252 enables second central suction-delivery tube 234, second peripheral suction-delivery tube 236, and second fluid-delivery tube 238 to pass through drum 108 and exit from a top of drum 108 for connection to a respective vacuum source and cleaning-fluid source, associated therewith. Second delivery-tube passage 252 also retains second central suction-delivery tube 234, second peripheral suction-delivery tube 236, and second fluid-delivery tube 238 during rotation of drum 108 about first axis 110.

In an example, second delivery-tube passage 252 has a second central axis that is parallel to first axis 110. In some examples, second central suction-delivery tube 234 extends from second brush cover 240, through second delivery-tube passage 252, and is connected to a service port of the vacuum source. In some examples, second peripheral suction-delivery tube 236 extends from second brush cover 240, through second delivery-tube passage 252, and is connected to another service port of the vacuum source. In some examples, second fluid-delivery tube 238 extends from second brush cover 240, through second delivery-tube passage 252, and is connected to a service port of the cleaning-fluid source.

Referring generally to FIGS. 1A, 1B, 1C, and 1D and particularly to, e.g., FIGS. 4, 11, and 15, apparatus 100 further comprises second delivery tube guide 198, connected to drum 108 and aligned with second delivery-tube passage 252. The preceding subject matter of this paragraph characterizes example 41 of the present disclosure, wherein example 41 also includes the subject matter according to example 40, above.

Second delivery tube guide 198 protects and guides second central suction-delivery tube 234, second peripheral suction-delivery tube 236, and second fluid-delivery tube 238 into second delivery-tube passage 252.

Referring generally to FIGS. 1A, 1B, 1C, and 1D and particularly to, e.g., FIGS. 2, 4, and 6, handle 126 comprises third delivery-tube passage 290, extending through handle support 134. Central suction-delivery tube 122, peripheral suction-delivery tube 222, and fluid-delivery tube 120 extend through third delivery-tube passage 290. The preceding subject matter of this paragraph characterizes example 42 of the present disclosure, wherein example 42 also includes the subject matter according to example 41, above.

Third delivery-tube passage 290 enables central suction-delivery tube 122, peripheral suction-delivery tube 222, and fluid-delivery tube 120 to pass through handle support 134 for connection to a respective vacuum source and cleaning-fluid source, associated therewith. Third delivery-tube passage 290 also retains central suction-delivery tube 122, peripheral suction-delivery tube 222, and fluid-delivery tube 120 during rotation of drum 108 about first axis 110.

Referring generally to FIGS. 1A, 1B, 1C, and 1D and particularly to, e.g., FIGS. 2, 4, and 6, second central suction-delivery tube 234, second peripheral suction-delivery tube 236, and second fluid-delivery tube 238 extend through third delivery-tube passage 290. The preceding subject matter of this paragraph characterizes example 43 of the present disclosure, wherein example 43 also includes the subject matter according to example 42, above.

Third delivery-tube passage 290 enables second central suction-delivery tube 234, second peripheral suction-delivery tube 236, and second fluid-delivery tube 238 to pass through handle support 134 for connection to a respective vacuum source and cleaning-fluid source, associated therewith. Third delivery-tube passage 290 also retains second central suction-delivery tube 234, second peripheral suction-delivery tube 236, and second fluid-delivery tube 238 during rotation of drum 108 about first axis 110.

Referring generally to FIGS. 1A, 1B, 1C, and 1D and particularly to, e.g., FIGS. 2, 4, and 6, handle 126 comprises fourth delivery-tube passage 292, extending through handle grip 118. Central suction-delivery tube 122, peripheral suction-delivery tube 222, and fluid-delivery tube 120 extend through fourth delivery-tube passage 292. The preceding subject matter of this paragraph characterizes example 44 of the present disclosure, wherein example 44 also includes the subject matter according to example 43, above.

Fourth delivery-tube passage 292 enables central suction-delivery tube 122, peripheral suction-delivery tube 222, and fluid-delivery tube 120 to pass through handle grip 118 for connection to a respective vacuum source and cleaning-fluid source, associated therewith. Fourth delivery-tube passage 292 also retains central suction-delivery tube 122, peripheral suction-delivery tube 222, and fluid-delivery tube 120 during rotation of drum 108 about first axis 110.

Referring generally to FIGS. 1A, 1B, 1C, and 1D and particularly to, e.g., FIGS. 2, 4, and 6, second central suction-delivery tube 234, second peripheral suction-delivery tube 236, and second fluid-delivery tube 238 extend through fourth delivery-tube passage 292. The preceding subject matter of this paragraph characterizes example 45 of the present disclosure, wherein example 45 also includes the subject matter according to example 44, above.

Fourth delivery-tube passage 292 enables second central suction-delivery tube 234, second peripheral suction-delivery tube 236, and second fluid-delivery tube 238 to pass through handle grip 118 for connection to a source. Third delivery-tube passage 290 also retains second central suction-delivery tube 234, second peripheral suction-delivery tube 236, and second fluid-delivery tube 238 during rotation of drum 108 about first axis 110.

In some examples, central suction-delivery tube 122, second central suction-delivery tube 234, peripheral suction-delivery tube 222, and second peripheral suction-delivery tube 236 extend from drum 108 (e.g., delivery-tube passage 250 and second delivery-tube passage 252), through third delivery-tube passage 290 and fourth delivery-tube passage 292, and are to service ports of the vacuum source. In some examples, fluid-delivery tube 120 and second fluid-delivery tube 238 extend from drum 108 (e.g., delivery-tube passage 250 and second delivery-tube passage 252), through third delivery-tube passage 290 and fourth delivery-tube passage 292, and are to a service port of the cleaning-fluid source.

Referring generally to FIGS. 1A, 1B, 1C, and 1D and particularly to, e.g., FIG. 8, drum 108 comprises splines 162, projecting outwardly from drum 108. Drum power-transmitting component 132 comprises teeth 164, configured to mate with splines 162 of drum 108. The preceding subject matter of this paragraph characterizes example 46 of the present disclosure, wherein example 46 also includes the subject matter according to any one of examples 1 to 45, above.

Mating engagement of teeth 164 of drum power-transmitting component 132 and splines 162 of drum 108 enables selective rotation of drum 108 in response to controlled rotation of drum power-transmitting component 132 by drum motor 130.

In some examples, splines 162 of drum 108 project radially outward from and are located circumferentially around an exterior of drum 108. In an example, with drum 108 coupled to bracket 104, splines 162 are oriented parallel to each other and with first axis 110. In an example, splines 162 generally extend from one (e.g., the first) end of drum 108 to the other (e.g., the second) end of drum 108. In an example, splines 162 extend between annular bearings 310, which are coupled to drum 108. In an example, splines 162 are located on only a circumferential portion of drum 108 that is engaged by drum power-transmitting component 132.

Referring generally to FIGS. 1A, 1B, 1C, and 1D and particularly to, e.g., FIG. 18, bracket 104 comprises tensioner 254, configured to tension drum power-transmitting component 132 with respect to drum motor 130 and drum 108. The preceding subject matter of this paragraph characterizes example 47 of the present disclosure, wherein example 47 also includes the subject matter according to example 46, above.

Tensioner 254 applies adjustable tension to drum power-transmitting component 132.

With tensioner 254 engaged with and applying tension to drum power-transmitting component 132, drum power-transmitting component 132 maintains contact with a circumferential portion of drum 108 so that teeth 164 of drum power-transmitting component 132 remain mated with splines 162 of drum 108.

Referring generally to FIGS. 1A, 1B, 1C, and 1D and particularly to, e.g., FIG. 18, tensioner 254 comprises tensioner base 256, coupled to bracket 104, and tensioner pulley 258, coupled to tensioner base 256 and rotatable relative to tensioner base 256 about ninth axis 260, which is parallel to first axis 110. Tensioner pulley 258 is configured to engage drum power-transmitting component 132. The preceding subject matter of this paragraph characterizes example 48 of the present disclosure, wherein example 48 also includes the subject matter according to example 47, above.

Tensioner base 256 sets a position of tensioner pulley 258 relative to bracket 104 and in tension with drum power-transmitting component 132. Rotation of tensioner pulley 258 about ninth axis 260 enables free rotational movement of drum power-transmitting component 132.

Referring generally to FIGS. 1A, 1B, 1C, and 1D and particularly to, e.g., FIG. 18, tensioner base 256 is linearly moveable relative to bracket 104. Tensioner base 256 is not rotatable relative to bracket 104. The preceding subject matter of this paragraph characterizes example 49 of the present disclosure, wherein example 49 also includes the subject matter according to example 48, above.

Linear movement of tensioner base 256 relative to bracket 104 enables adjustment of a position of tensioner base 256 relative to bracket 104 and adjustment of a tension applied to drum power-transmitting component 132 by tensioner pulley 258. Fixing a rotational orientation of tensioner base 256 relative to bracket 104 fixes ninth axis 260 of tensioner pulley 258 parallel to first axis 110 and enables tensioner pulley 258 to maintain positive contact with drum power-transmitting component 132.

In some examples, tensioner base 256 is configured to move linearly away from bracket 104 and toward bracket 104. In an example, bracket 104 includes bracket wall 330. Tensioner base 256 is mounted to an interior of bracket wall 330 and is linearly movable relative to bracket wall 330. In an example, bracket wall 330 includes, or defines, bracket wall-opening 332. Bracket wall-opening 332 provides access to drum 108 for drum power-transmitting component 132, which passes through bracket wall-opening 332. In some examples, tensioner 254 is located within bracket wall-opening 332.

In some examples, bracket 104 also includes a clearance hole and counterbore, which is coaxial with the clearance hole. Tensioner 254 also includes a fastener, passing through the clearance hole and through the counterbore. The fastener is threaded into tensioner base 256. The fastener connects tensioner 254 to bracket 104. The fastener also enables linear movement of tensioner base 256 relative to bracket 104. In some examples, the fastener is configured to control a position of tensioner base 256 relative to bracket 104. Linear movement of tensioner base 256 relative to bracket 104 enables a reduction or increase the tension applied to drum power-transmitting component 132 by tensioner pulley 258. In an example, tensioner 254 also includes a slide pin, which is fixed relative to one of bracket 104 or tensioner base 256, and is movable relative to other one of bracket 104 or tensioner base 256. The slide pin enables linear movement of tensioner base 256 relative to bracket 104 and prohibits rotational movement of tensioner base 256 about the fastener relative to bracket 104. Non-rotation of tensioner pulley 258 maintains an orientation of drum power-transmitting component 132 during co-rotation of drum power-transmitting component 132 and drum 108. In an example, tension 254 also includes a tensioner-biasing element, such as a compression spring, which is positioned between bracket 104 and tensioner base 256. In an example, the compression spring is located within the counterbore. The compression spring enables tensioner base 256 to be pushed, or biased, away from bracket 104 to position tensioner pulley 258 in tension with drum power-transmitting component 132. In some examples, the compression spring is a helical, or coil, compression spring located around the fastener with one end engaged with tensioner base 256 and the other end engaged with an interior surface of the counterbore.

Referring generally to FIGS. 1A, 1B, 1C, and 1D and particularly to, e.g., FIG. 4, apparatus 100 further comprises sensor 262, configured to detect when drum 108 is in a predetermined rotational orientation relative to bracket 104, and homing element 264, coupled to drum 108 and configured to actuate sensor 262 when drum 108 is rotated about first axis 110 to the predetermined rotational orientation. The preceding subject matter of this paragraph characterizes example 50 of the present disclosure, wherein example 50 also includes the subject matter according to any one of examples 1 to 49, above.

Homing element 264 enables actuation of sensor 262 when drum 108 is rotated to the predetermined rotational orientation relative to bracket 104, for example, to indicate that drum 108 is in a home position.

In an example, sensor 262 is mounted to coupling 168 and is located proximate to drum 108. Use of homing element 264 and sensor 262 to indicate the home position also enables use of an incremental position encoder, which is capable of determining the rotational orientation of drum 108 relative to bracket 104 following a power interruption. One the other hand, an absolute position encoder would be unable to determine the rotational orientation of drum 108 relative to bracket 104 in case of a power interruption.

In an example, apparatus 100 includes a rotary encoder (not shown), for example, communicatively coupled with the controller, that converts the angular position or motion of drum-motor output shaft 284 to an analog or digital signal. The output of the incremental encoder provides information about the motion of drum-motor output shaft 284, which is further processed into information such as speed, distance and position, whereas the output of the absolute encoder indicates the current position of drum-motor output shaft 284.

In some examples, sensor 262 is a proximity sensor. In an example, homing element 264 includes a magnet, coupled to drum 108, and sensor 262 is a magnetic sensor. The magnet enables non-contact actuation of the magnetic sensor when drum 108 is rotated to the predetermined rotational orientation relative to bracket 104 to indicate that drum 108 is in the home position.

Referring generally to FIGS. 1A, 1B, 1C, and 1D and particularly to, e.g., FIG. 18, bracket 104 comprises first bracket portion 270 and second bracket portion 272, removably coupled to first bracket portion 270. Drum 108 is configured to be separated from bracket 104 along first axis 110 when second bracket portion 272 is removed from first bracket portion 270. The preceding subject matter of this paragraph characterizes example 51 of the present disclosure, wherein example 51 also includes the subject matter according to any one of examples 1 to 50, above.

Bracket 104 that has two portions enables removal of drum 108, and other components of apparatus 100 coupled to drum 108, without completely removing bracket 104 from coupling 168.

In some examples, upon removal of second bracket portion 272 of bracket 104 from first bracket portion 270 of bracket 104, drum 108 is capable of being withdrawn from within first bracket portion 270 of bracket 104 along first axis 110. In some examples, at least one of first bracket portion 270 and second bracket portion 272 of bracket 104 is removably coupled with coupling 168 such that drum power-transmitting component 132 is capable of entering bracket 104, for example, through bracket wall-opening 332.

In some examples, bracket 104 includes shoulders 336 that project inward from bracket wall 330. In some examples, bracket 104 is configured to capture and retain drum 108 between shoulders 336 upon second bracket portion 272 of bracket 104 being coupled to first bracket portion 270 of bracket 104 and to coupling 168. In some examples, a first one of shoulders 336 engages the first one of annular bearings 310 that is coupled to drum 108 and a second one of shoulders 336 engages the second one of annular bearings 310 that is coupled to drum 108.

Referring generally to FIGS. 1A, 1B, 1C, 1D, and 2-18 and particularly to, e.g., FIG. 19, method 1000 of cleaning surface 102 is disclosed. Method 1000 comprises (block 1002) positioning brush 112 in contact with surface 102, (block 1004) rotating brush 112 about second axis 116 relative to drum 108, and (block 1006) rotating drum 108 about first axis 110 relative to bracket 104, connected to handle 126 and rotatably supporting drum 108, such that brush 112 orbitally revolves about first axis 110. According to method 1000, first axis 110 is parallel to second axis 116. The preceding subject matter of this paragraph characterizes example 52 of the present disclosure.

Method 1000 enables partially automated cleaning of (e.g., removal of contaminates from) surface 102. With brush 112 positioned in contact with surface 102, rotation of brush 112 relative to drum 108 about second axis 116 provides the first cleaning action to surface 102 (e.g., spinning brush 112 about second axis 116 on surface 102). With brush 112 positioned in contact with surface 102, rotation of drum 108 relative to bracket 104 about first axis 110 orbitally revolves brush 112 about first axis 110 relative to surface 102 along the cleaning path relative to surface 102 and provides the second cleaning action to surface 102 (e.g., orbitally revolving brush 112 about first axis 110 on surface 102). The configuration of drum 108, brush motor 114 and brush 112 beneficially reduces the overall size of apparatus 100 and enables apparatus 100 to clean surface 102 of a structure or other article, for example, located within a confined space.

In some examples, brush 112 is positioned in contact with surface 102 via manual manipulation of handle 126. In some examples, rotation of drum 108 relative to bracket 104 is selectively controlled. In an example, the controller transmits commands to drum motor 130, which rotates drum 108 relative to bracket 104 about first axis 110. In some examples, drum 108 is fully rotatable about first axis 110 and is configured to complete one or more 360-degree rotations in a first rotational direction (e.g., clockwise). In some examples, drum 108 is fully rotatable about first axis 110 and is configured to complete one or more 360-degree rotations in the first rotational direction (e.g., clockwise) and one or more 360-degree rotations in a second rotational direction (e.g., counterclockwise). For example, drum 108 oscillates in full rotation. In some examples, drum 108 is partially rotatable, less than 360-degree, about first axis 110. In an example, drum 108 partially rotates in the first rotational direction (e.g., clockwise) and then partially rotates in the second rotational direction (e.g., counter clockwise). For example, drum 108 oscillates in partial rotation.

In some examples, rotation of brush 112 relative to drum 108 about second axis 116 is selectively controlled. In an example, the controller transmits commands to brush motor 114, which rotates brush 112 relative to drum 108 about second axis 116. In some examples, brush 112 is fully rotatable about second axis 116 and is configured to complete one or more 360-degree rotations in a first rotational direction (e.g., clockwise), for example, brush 112 spins about second axis 116. In some examples, brush 112 is fully rotatable about second axis 116 and is configured to complete one or more 360-degree rotations in the first rotational direction (e.g., clockwise) and one or more 360-degree rotations in a second rotational direction (e.g., counter clockwise). For example, brush 112 oscillates in full rotation. In some examples, brush 112 is partially rotatable, less than 360-degree, about second axis 116. In an example, brush 112 partially rotates in the first rotational direction (e.g., clockwise) and then partially rotates in the second rotational direction (e.g., counter clockwise). For example, brush 112 oscillates in partial rotation.

Referring generally to FIGS. 1A, 1B, 1C, 1D, 9, and 15-17 and particularly to, e.g., FIG. 19, method 1000 further comprises (block 1008) positioning second brush 144 in contact with surface 102, (block 1010) rotating second brush 144 relative to drum 108 about fourth axis 150, and (block 1012) rotating drum 108 relative to bracket 104 about first axis 110 such that second brush 144 orbitally revolves about first axis 110. According to method 1000, fourth axis 150 is parallel to first axis 110. The preceding subject matter of this paragraph characterizes example 53 of the present disclosure, wherein example 53 also includes the subject matter according to example 52, above.

With second brush 144 positioned in contact with surface 102, rotation of second brush 144 relative to drum 108 provides the third cleaning action to surface 102 (e.g., spinning second brush 144 about fourth axis 150 on surface 102). With second brush 144 positioned in contact with surface 102, rotation of drum 108 relative to bracket 104 about first axis 110 orbitally revolves second brush 144 about first axis 110 relative to surface 102 along the second cleaning path relative to surface 102 and provides the fourth cleaning action to surface 102 (e.g., orbitally revolving second brush 144 about first axis 110 on surface 102). The configuration of drum 108, second brush motor 138 and second brush 144 beneficially reduces the overall size of apparatus 100 and enables apparatus 100 to clean surface 102 of a structure or other article, for example, located within a confined space.

In some examples, second brush 144 is positioned in contact with surface 102 via manual manipulation of handle 126. In some examples, rotation of second brush 144 relative to drum 108 about fourth axis 150 is selectively controlled. In an example, the controller transmits commands to second brush motor 138, which rotates second brush 144 relative to drum 108 about fourth axis 150. In some examples, second brush 144 is fully rotatable about fourth axis 150 and is configured to complete one or more 360-degree rotations in a first rotational direction (e.g., clockwise), for example, second brush 144 spins about fourth axis 150. In some examples, second brush 144 is fully rotatable about fourth axis 150 and is configured to complete one or more 360-degree rotations in the first rotational direction (e.g., clockwise) and one or more 360-degree rotations in a second rotational direction (e.g., counter clockwise). For example, second brush 144 oscillates in full rotation. In some examples, second brush 144 is partially rotatable, less than 360-degree, about fourth axis 150. In an example, second brush 144 partially rotates in the first rotational direction (e.g., clockwise) and then partially rotates in the second rotational direction (e.g., counter clockwise). For example, the second brush 144 oscillates in partial rotation.

Referring generally to FIGS. 1A, 1B, 1C, 1D, 5, 6, 8, 9, and 11-15 and particularly to, e.g., FIG. 19, method 1000 further comprises (block 1014) spacing brush 112 laterally outboard relative to drum 108 by brush arm 154, connected to drum 108. The preceding subject matter of this paragraph characterizes example 54 of the present disclosure, wherein example 54 also includes the subject matter according to example 53, above.

Locating brush 112 laterally outboard relative to drum 108 spaces second axis 116 laterally outboard relative to first axis 110 to increase size of the cleaning path and enables brush 112 to access locations on surface 102 that are inaccessible to bracket 104.

Referring generally to FIGS. 1A, 1B, 1C, 1D, 5, 6, 8, 9, and 11-15 and particularly to, e.g., FIG. 19, method 1000 further comprises (block 1016) spacing second brush 144 laterally outboard relative to drum 108 by second brush arm 156, connected to drum 108. The preceding subject matter of this paragraph characterizes example 55 of the present disclosure, wherein example 55 also includes the subject matter according to example 54, above.

Locating second brush 144 laterally outboard relative to drum 108 spaces fourth axis 150 laterally outboard relative to first axis 110 to increase size of the cleaning path and enables second brush 144 to access locations on surface 102 that are inaccessible to bracket 104.

Referring generally to FIGS. 1A, 1B, 1C, 1D, 14, and 15 and particularly to, e.g., FIG. 19, method 1000 further comprises (block 1018) rotating brush arm 154 relative to drum 108 about sixth axis 208, which is parallel to first axis 110 and second axis 116, such that brush 112 orbitally revolves about sixth axis 208. The preceding subject matter of this paragraph characterizes example 56 of the present disclosure, wherein example 56 also includes the subject matter according to example 55, above.

Rotating brush arm 154 relative to drum 108 about sixth axis 208 provides another path of motion for brush 112 relative to surface 102.

In some examples, rotation of brush arm 154 relative to drum 108 is selectively controlled. In an example, the controller transmits commands to brush-arm motor 192, which rotates brush arm 154 relative to drum 108 about sixth axis 208. In some examples, brush arm 154 is fully rotatable about sixth axis 208 and is configured to complete one or more complete (360-degree) rotations in a first rotational direction (e.g., clockwise) such that brush 112 fully orbitally revolves about sixth axis 208. In some examples, brush arm 154 is fully rotatable about sixth axis 208 and is configured to complete one or more 360-degree rotations in the first rotational direction (e.g., clockwise) and one or more 360-degree rotations in a second rotational direction (e.g., counter clockwise). For example, brush 112 orbitally oscillates about sixth axis 208 in full rotation. In some examples, brush arm 154 is partially rotatable about sixth axis 208 and is configured to complete a partial, less than 360-degree, rotation in the first rotational direction (e.g., clockwise) and a partial rotation in the second rotational direction (e.g., counter clockwise). For example, brush 112 orbitally oscillates about sixth axis 208 in partial rotation.

Referring generally to FIGS. 1A, 1B, 1C, 1D, 14, and 15 and particularly to, e.g., FIG. 19, method 1000 further comprises (block 1020) rotating second brush arm 156 relative to drum 108 about seventh axis 214, which is parallel to first axis 110 and fourth axis 150, such that second brush 144 orbitally revolves about seventh axis 214. The preceding subject matter of this paragraph characterizes example 57 of the present disclosure, wherein example 57 also includes the subject matter according to example 56, above.

Rotating brush arm 154 relative to drum 108 about sixth axis 208 provides another path of motion for brush 112 relative to surface 102.

In some examples, rotation of second brush arm 156 relative to drum 108 is selectively controlled. In an example, the controller transmits commands to brush-arm motor 192, which rotates second brush arm 156 relative to drum 108 about seventh axis 214. In some examples, second brush arm 156 is partially rotatable about seventh axis 214 and is configured to complete a partial (less than 360-degree) rotation in a first rotational direction (e.g., clockwise) and a partial rotation in a second rotational direction (e.g., counter clockwise). For example, second brush 144 orbitally oscillates about seventh axis 214 in partial rotation.

Referring generally to FIGS. 1A, 1B, 1C, 1D, and 12-17 and particularly to, e.g., FIG. 19, method 1000 further comprises (block 1022) delivering suction to a center of brush 112 via central suction-delivery tube 122, communicatively coupled with brush cover 224, at least partially surrounding brush 112. The preceding subject matter of this paragraph characterizes example 58 of the present disclosure, wherein example 58 also includes the subject matter according to any one of examples 53 to 57, above.

Delivering suction to the center of brush 112 enables capture and removal of contaminants and/or fumes generating during a cleaning operation.

Referring generally to FIGS. 1A, 1B, 1C, 1D, and 12-17 and particularly to, e.g., FIG. 19, method 1000 further comprises (block 1024) delivering suction to a periphery of brush 112 via peripheral suction-delivery tube 222, communicatively coupled with brush cover 224. The preceding subject matter of this paragraph characterizes example 59 of the present disclosure, wherein example 59 also includes the subject matter according to example 58, above.

Delivering suction to the periphery of brush 112 enables capture and removal of contaminates, generated during the cleaning operation and/or cleaning fluid used during the cleaning operation.

Referring generally to FIGS. 1A, 1B, 1C, 1D, and 12-17 and particularly to, e.g., FIG. 19, method 1000 further comprises (block 1026) delivering cleaning fluid to brush 112 via fluid-delivery tube 120, communicatively coupled with brush cover 224. The preceding subject matter of this paragraph characterizes example 60 of the present disclosure, wherein example 60 also includes the subject matter according to example 59, above.

Delivery of cleaning fluid to brush 112 improves cleaning action, generated by rotation of brush 112.

Referring generally to FIGS. 1A, 1B, 1C, 1D, and 12-17 and particularly to, e.g., FIG. 19, method 1000 further comprises (block 1028) delivering suction to a second center of second brush 144 via second central suction-delivery tube 234, communicatively coupled with second brush cover 240, at least partially surrounding second brush 144. The preceding subject matter of this paragraph characterizes example 61 of the present disclosure, wherein example 61 also includes the subject matter according to example 60, above.

Delivering suction to the center of second brush 144 enables capture and removal of contaminants and/or fumes generating during a cleaning operation.

Referring generally to FIGS. 1A, 1B, 1C, 1D, and 12-17 and particularly to, e.g., FIG. 19, method 1000 further comprises (block 1030) delivering suction to a second periphery of second brush 144 via second peripheral suction-delivery tube 236, communicatively coupled with second brush cover 240. The preceding subject matter of this paragraph characterizes example 62 of the present disclosure, wherein example 62 also includes the subject matter according to example 61, above.

Delivering suction to the periphery of second brush 144 enables capture and removal of contaminates generating during the cleaning operation and/or cleaning fluid used during the cleaning operation.

Referring generally to FIGS. 1A, 1B, 1C, 1D, and 12-17 and particularly to, e.g., FIG. 19, method 1000 further comprises (block 1032) delivering cleaning fluid to second brush 144 via second fluid-delivery tube 238, communicatively coupled with second brush cover 240. The preceding subject matter of this paragraph characterizes example 63 of the present disclosure, wherein example 63 also includes the subject matter according to example 62, above.

Delivery of cleaning fluid to second brush 144 improves cleaning action, generated by rotation of second brush 144.

Referring generally to FIGS. 1A, 1B, 1C, 1D, and 4 and particularly to, e.g., FIG. 19, method 1000 further comprises (block 1034) detecting when drum 108 is in a predetermined rotational orientation relative to bracket 104 by actuating sensor 262, located proximate to drum 108, with homing element 264, located on drum 108. The preceding subject matter of this paragraph characterizes example 64 of the present disclosure, wherein example 64 also includes the subject matter according to any one of examples 53 to 63, above.

Detecting the rotational orientation of drum 108 relative to bracket 104 enables actuation of sensor 262 when drum 108 is rotated by drum motor 130 to the predetermined rotational orientation relative to bracket 104 to indicate drum 108 is in the home position. Detecting the rotational orientation of drum 108 also enables use of an incremental, rather than an absolute, position encoder, which would be unable to determine the rotational orientation of drum 108 relative to bracket 104 in the case of a power interruption.

Examples of the present disclosure may be described in the context of aircraft manufacturing and service method 1100 as shown in FIG. 20 and aircraft 1102 as shown in FIG.

21. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 21, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus (es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service (block 1114) and/or during maintenance and service (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus (es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. A method of cleaning a surface, the method comprising steps of:

positioning a brush in contact with the surface;

spacing the brush laterally outboard relative to a drum with a brush arm, connected to the drum;

rotating the brush about a second axis relative to the drum; and rotating the drum about a first axis relative to a bracket, connected to a handle and rotatably supporting the drum, such that the brush orbitally revolves about the first axis, wherein the first axis is parallel to the second axis.

2. The method according to claim 1, further comprising:

positioning a second brush in contact with the surface; and rotating the second brush relative to the drum about a fourth axis.

3. The method according to claim 2, further comprising rotating the drum relative to the bracket about the first axis such that the second brush orbitally revolves about the first axis, wherein the fourth axis is parallel to the first axis.

4. The method according to claim 2, further comprising spacing the second brush laterally outboard relative to the drum with a second brush arm, connected to the drum.

5. The method according to claim 1, further comprising rotating the brush arm relative to the drum about a sixth axis, which is parallel to the first axis and the second axis, such that the brush orbitally revolves about the sixth axis.

6. The method according to claim 2, further comprising rotating the second brush arm relative to the drum about a seventh axis, which is parallel to the first axis and the fourth axis, such that the second brush orbitally revolves about the seventh axis.

7. The method according to claim 1, further comprising delivering suction to a center of the brush via a central suction-delivery tube, communicatively coupled with a brush cover, at least partially surrounding the brush.

8. The method according to claim 1, further comprising delivering suction to a periphery of the brush via a peripheral suction-delivery tube, communicatively coupled with the brush cover.

9. The method according to claim 1, further comprising delivering cleaning fluid to the brush via a fluid-delivery tube, communicatively coupled with the brush cover.

10. The method according to claim 2, further comprising delivering suction to a second center of the second brush via a second central suction-delivery tube, communicatively coupled with a second brush cover, at least partially surrounding the second brush.

11. The method according to claim 2, further comprising delivering suction to a second periphery of the second brush via a second peripheral suction-delivery tube, communicatively coupled with the second brush cover.

12. The method according to claim 2, further comprising delivering cleaning fluid to the second brush via a second fluid-delivery tube, communicatively coupled with the second brush cover.

13. The method according to claim 1, further comprising detecting when the drum is in a predetermined rotational orientation relative to the bracket by actuating a sensor, located proximate to the drum, with a homing element, located on the drum.

14. The method according to claim 1, wherein the step of rotating the brush about the second axis comprises rotationally coupling the brush with a brush motor 44.

15. The method according to claim 1, wherein the step of rotating the drum about the first axis comprises rotationally coupling the drum with a drum motor.

16. The method according to claim 1, further comprising delivering cleaning fluid to the brush.

17. The method according to claim 1, wherein the step of positioning the brush in contact with the surface comprises manual manipulation of the handle.

18. The method according to claim 1, wherein the step of rotating the brush about the second axis comprises rotating the brush in a first rotational direction about the second axis and rotating the brush in a second rotational direction about the second axis that is opposite of the first rotational direction.

19. A method of cleaning a surface, the method comprising steps of:

positioning a brush in contact with the surface;

rotating the brush about a second axis relative to a drum;

rotating the drum about a first axis relative to a bracket, connected to a handle and rotatably supporting the drum, such that the brush orbitally revolves about the first axis; and detecting when the drum is in a predetermined rotational orientation relative to the bracket by actuating a sensor, located proximate to the drum, with a homing element, located on the drum, wherein the first axis is parallel to the second axis.

20. A method of cleaning a surface, the method comprising steps of:

positioning a brush in contact with the surface;

rotating the brush about a second axis relative to a drum; and rotating the drum about a first axis relative to a bracket, connected to a handle and rotatably supporting the drum, such that the brush orbitally revolves about the first axis, and delivering at least one of cleaning fluid and suction to the brush, wherein the first axis is parallel to the second axis.

* * * * *